US008584637B2

(12) United States Patent
Scheidig

(10) Patent No.: US 8,584,637 B2
(45) Date of Patent: Nov. 19, 2013

(54) DEVICE FOR VARIABLY ADJUSTING THE CONTROL TIMES OF GAS EXCHANGE VALVES OF AN INTERNAL COMBUSTION ENGINE

(75) Inventor: Gerhard Scheidig, Oberasbach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 13/511,202

(22) PCT Filed: Nov. 24, 2010

(86) PCT No.: PCT/EP2010/068079
§ 371 (c)(1),
(2), (4) Date: May 22, 2012

(87) PCT Pub. No.: WO2011/064228
PCT Pub. Date: Jun. 3, 2011

(65) Prior Publication Data

US 2012/0227693 A1 Sep. 13, 2012

(30) Foreign Application Priority Data

Nov. 27, 2009 (DE) ..... 10 2009 056 021

(51) Int. Cl.
*F01L 1/34* (2006.01)

(52) U.S. Cl.
USPC ..... 123/90.17; 123/90.15

(58) Field of Classification Search
USPC ..... 123/90.15, 90.17, 90.31
See application file for complete search history.

(56) References Cited

U.S. PATENT DOCUMENTS

| | | | | |
|---|---|---|---|---|
| 5,107,804 | A | 4/1992 | Becker et al. | |
| 5,263,443 | A | 11/1993 | Schechter et al. | |
| 6,186,104 | B1 | 2/2001 | Torii et al. | |
| 7,444,971 | B2 * | 11/2008 | Suga et al. | 123/90.17 |
| 2007/0039581 | A1 | 2/2007 | Berndorfer | |
| 2009/0133652 | A1 | 5/2009 | Fujyoshi et al. | |

FOREIGN PATENT DOCUMENTS

| | | |
|---|---|---|
| DE | 19850947 | 5/2000 |
| DE | 102007035672 | 1/2009 |
| EP | 0806550 | 11/1997 |
| EP | 1783334 | 5/2007 |
| EP | 2075421 | 7/2009 |
| WO | 2008067935 | 6/2008 |

* cited by examiner

*Primary Examiner* — Zelalem Eshete
(74) *Attorney, Agent, or Firm* — Volpe and Koenig, P.C.

(57) ABSTRACT

A camshaft adjuster (11) for a camshaft (35), by which cylinder valves (12) of an internal combustion engine are actuated, wherein late torques by the camshaft (35) act on the camshaft adjuster (11) in the direction of later cylinder valve opening times when the cam is rising, and opposing early torques act on the camshaft adjuster (11) in the direction of earlier opening times when the cam is falling, wherein the feeding and draining of pressure medium can be controlled by a control unit (20), wherein a torque mode or a pump mode can be selectively adjusted by the control unit (20), wherein primarily camshaft torques are used for building up pressure in the first partial chamber A or in the second partial chamber B in the torque mode, while the pressure build-up in the first partial chamber A or in the second partial chamber B in the pump mode is primarily brought about by pressure medium provided by a pressure medium pump P. The control unit includes a control valve (101) and a rotary transfer device (103), wherein the desired adjusting direction and the pump or torque mode can be adjusted by the control valve (101) and the adaptation to the occurring camshaft torques can be adjusted by the rotary transfer device (103).

9 Claims, 35 Drawing Sheets

DEVICE FOR VARIABLY ADJUSTING THE CONTROL TIMES OF GAS EXCHANGE VALVES OF AN INTERNAL COMBUSTION ENGINE

FIELD OF THE INVENTION

The invention relates to a device for variably adjusting the timing of gas exchange valves of an internal combustion engine, having a hydraulic phase adjustment unit, wherein the phase adjustment unit can be placed in drive connection with a crankshaft and with a camshaft and has at least one advance chamber and at least one retardation chamber, to and from which pressure medium can be supplied and discharged via pressure medium lines, wherein a phase position of the camshaft relative to the crankshaft can be adjusted by means of a supply of pressure medium to the adjustment chambers.

BACKGROUND

In modern internal combustion engines, devices for variably adjusting the timing of gas exchange valves are used to enable variable configuration of the phase position of a camshaft relative to a crankshaft within a defined angular range between a maximum advanced position and a maximum retarded position. For this purpose, a hydraulic phase adjustment unit of the device is integrated into a drive train via which torque is transmitted from the crankshaft to the camshaft. This drive train can be implemented for example as a belt, chain or gear drive. The phase adjustment speed and the pressure medium requirement are significant parameters of such devices. To enable the phase position to be adapted in an optimum manner to the various driving situations, high phase adjustment speeds are desirable. In the context of measures for reducing consumption, there is furthermore a demand for an ever smaller pressure medium requirement so as to enable the pressure medium pump of the internal combustion engine to be of smaller design or to enable the delivery rate to be reduced when using regulated pressure medium pumps.

A device of this type is known for example from EP 0 806 550 A1. The device comprises a vane-type phase adjustment unit with a drive input element, which is in drive connection with the crankshaft, and a drive output element, which is connected to the camshaft for conjoint rotation therewith. A plurality of pressure spaces are formed within the phase adjustment unit, wherein each of the pressure spaces is divided into two oppositely acting pressure chambers by means of a vane. The vanes are moved within the pressure spaces by means of a supply of pressure medium to or discharge of pressure medium from the pressure chambers, which brings about a change in the phase position between the drive output element and the drive input element. In this case, the pressure medium required for phase adjustment is provided by a pressure medium pump of the internal combustion engine and is directed selectively to the advance or retardation chambers by means of a control valve. The pressure medium flowing out of the phase adjustment unit is directed into a pressure medium reservoir, the oil sump of the internal combustion engine. Phase adjustment is thus accomplished by means of the system pressure provided by the pressure medium pump of the internal combustion engine.

A further device is known for example from U.S. Pat. No. 5,107,804 A. In this arrangement, the phase adjustment unit is likewise of the vane type, and a plurality of advance and retardation chambers is provided. In contrast to EP 0 806 550 A1, phase adjustment is not accomplished by supplying pressure medium to the pressure chambers by means of a pressure medium pump; instead, alternating moments acting on the camshaft are used. The alternating moments are caused by the rolling movements of the cams on the gas exchange valves, each of which is preloaded by a valve spring. In this case, the rotary motion of the camshaft is braked during the opening of the gas exchange valves and accelerated during closure. These alternating moments are transmitted to the phase adjustment unit, with the result that the vanes are periodically subjected to a force in the direction of the retardation stop and of the advance stop. As a result, pressure peaks are produced alternately in the advance chambers and the retardation chambers. If the phase position is supposed to be held constant, pressure medium is prevented from flowing out of the pressure chambers. In the case of a phase adjustment in the direction of earlier timing, pressure medium is prevented from flowing out of the advance chambers, even at times at which pressure peaks are being produced in the advance chambers. If the pressure in the retardation chambers rises owing to the alternating moments, this pressure is used to direct pressure medium out of the retardation chambers into the advance chambers, using the pressure of the pressure peak generated. Phase adjustment in the direction of later timing is accomplished in a similar way. In addition, the pressure chambers are connected to a pressure medium pump, although only to compensate for leaks from the phase adjustment unit. Phase adjustment is thus accomplished by diverting pressure medium out of the pressure chambers to be emptied into the pressure chambers to be filled, using the pressure of the pressure peak generated.

Another device is known from US 2009/0133652 A1. In this arrangement, phase adjustment in the case of small alternating moments is accomplished, in a manner similar to the device in EP 0 806 550 A1, by supplying pressure to the advance chambers or the retardation chambers by means of a pressure medium pump while simultaneously allowing pressure medium to flow out of the other pressure chambers to the oil sump of the internal combustion engine. In the case of high alternating moments, these are used, as in the device in U.S. Pat. No. 5,107,804 A, to direct the pressure medium under high pressure out of the advance chambers (retardation chambers) into the retardation chambers (advance chambers). During this process, the pressure medium expelled from the pressure chambers is fed back to a control valve, which controls the supply of pressure medium to or discharge of pressure medium from the pressure chambers. This pressure medium passes via check valves within the control valve to the inlet port, which is connected to the pressure medium pump, wherein some of the pressure medium is expelled into the pressure medium reservoir of the internal combustion engine.

EP 2 075 421 A1 discloses a valve for a camshaft adjuster. The valve comprises a valve piston which is arranged in a rotatable manner in a valve housing. Inlets and outlets for pressurized oil are arranged such that, by adjusting the valve piston, pressurized oil can be conducted to the adjustment chambers and to a locking mechanism. Here, the locking mechanism can be activated not only in an end position of the camshaft adjuster, that is to say at a stop in the retarded or advanced position, but also in an intermediate position. This permits mid-position locking, which may be expedient depending on the engine application.

DE 198 50 947 presents a device for controlling the timing of an internal combustion engine, having at least one drive means, at least one camshaft with cams, at least one hydraulically actuable adjustment unit for adjusting the angle of relative rotation between the drive means and the camshaft, at least one hydraulic fluid supply device for charging the adjustment unit, and at least one positive control unit by means of which the hydraulic charging of the adjustment unit can be influenced at least at times and/or at least in part as a function of the absolute angle of rotation of the camshaft and/or of the cams. Here, a flow connection to the adjustment chambers is shut off in a targeted manner when pressure fluctuations caused by torques arise which would be imparted back to the adjustment chambers by the camshaft when cams are running on or running off.

U.S. Pat. No. 6,186,104 B1 discloses a vane-type valve timing control device for an internal combustion engine, in which, between the pressure cells and the control valve which actuates them, there is connected a pressure distributor device which serves to suppress disturbance camshaft torques. For this purpose, for example during a retardation, the oil supply to the pressure cells is shut off when an advance torque arises. Conversely, during an advance, the oil supply to the pressure cells is shut off when a retardation torque arises. Similarly to DE 198 50 947, therefore, a return swing of the adjustment unit is suppressed owing to the adjustment of opposing camshaft torques.

SUMMARY

The invention is based on the object of providing a device for variably adjusting the timing of gas exchange valves of an internal combustion engine with a high phase adjustment speed.

The object is met according to the invention by specifying a camshaft adjuster for a camshaft which serves to actuate cylinder valves of an internal combustion engine, wherein retardation torques in the direction of retarded cylinder valve opening times are imparted back to the camshaft adjuster by the camshaft when cams are running on, and oppositely directed advance torques in the direction of advanced cylinder valve opening times are imparted back to the camshaft adjuster by the camshaft when cams are running off, having a pressure chamber and having an adjusting means arranged in the pressure chamber, wherein the adjusting means divides the pressure chamber into a first chamber part and a second chamber part, wherein pressure medium can be supplied to the first and the second chamber part and pressure medium can be discharged from the first chamber part and second chamber part, such that the adjusting means can be moved by a pressure difference between the first chamber part and second chamber part, resulting in a rotation of the camshaft, wherein, when a relatively high pressure prevails in the first chamber part, the camshaft is rotated in the direction of advanced cylinder valve opening times, and when a relatively high pressure prevails in the second chamber part, the camshaft is rotated in the direction of retarded cylinder valve opening times, and wherein the supply and discharge of pressure medium can be controlled by means of a control device, wherein a torque mode or a pump mode can be selectively set by means of the control device, wherein in the torque mode, predominantly camshaft torques are utilized to build up pressure in the first chamber part or in the second chamber part, whereas in the pump mode, the pressure build-up in the first chamber part or in the second chamber part is realized predominantly by means of pressure medium provided by a pressure medium pump.

In the prior art, two strategies have hitherto been followed for hydraulic camshaft adjustment: firstly, a provision of pressure medium by means of a pressure medium pump, generally an oil pump of an engine oil lubricating circuit, or a utilization of camshaft torques for generating the required adjustment pressure. The first strategy is also referred to as "oil pressure actuated" (OPA) and the second is referred to as "cam torque actuated" (CTA). The invention is now based on the realization that respective advantages of OPA and CTA methods can be expediently combined with one another as a function of an operating state of the internal combustion engine. In operating states in which a high pump pressure of the pressure medium pump is provided, the pump mode, that is to say an OPA method, is expediently selected, whereas in the event of low pump pressures but high camshaft torques, the torque mode, that is to say the CTA method, is used. Here, it is self-evidently possible for an adjustment in the CTA method to be assisted by the pressure medium pump in addition to the utilization of the camshaft torques, and vice versa.

Here, the invention is not restricted to a particular design of camshaft adjuster, that is to say, for example, use may be made of a vane-type adjuster in which multiple pairs of chamber parts are formed, wherein the adjustment means is a vane which divides the chamber parts and which is for example formed in one piece from a rotor or plugged into said rotor.

The control device preferably comprises a control valve and a rotary transmitter arranged on the camshaft, wherein pressure medium can be conducted to and discharged from the first chamber part through first orifices in the camshaft, and pressure medium can be conducted to and discharged from the second chamber part through second orifices in the camshaft, by means of the control valve and the rotary transmitter, wherein an orifice cover is arranged in the rotary transmitter such that the first orifices and second orifices are opened up or blocked as a function of the rotary angle of the camshaft.

In this embodiment, therefore, the supply and discharge of pressure medium to and from the chamber parts is realized by means of a control valve, a downstream rotary transmitter and orifices or oil channels in the camshaft. Here, the supply and discharge of pressure medium takes place as a function of a rotational angle of the camshaft. Said rotational angle corresponds in turn to the camshaft torques, such that a supply and discharge of pressure medium can be correspondingly synchronized with the respective camshaft torques as a function of the desired adjustment direction. Here, the orifice cover in the rotary transmitter opens up the first or second orifices, which respectively correspond to the chamber part to be actuated, depending on the occurrence of camshaft torques and the desired adjustment direction. Here, the first and second orifices need not lie in a region formed in one piece with the rest of the camshaft; in this regard the camshaft should also be regarded as including a component, an adapter or the like, which is mounted on the camshaft and rotates therewith. The orifice cover may be an inner side of a cylinder which surrounds the camshaft, wherein the recesses are formed for example by grooves. It is preferable here for in each case one groove to be provided corresponding to the first and second orifices, and for a further groove to be provided for the supply of pressure medium. The grooves then extend in the circumferential direction along a part of a circle, preferably approximately along a quarter circle in the case of a four-cylinder engine.

The orifice cover is preferably formed by the inner side of a bearing shell in which the camshaft is mounted, wherein the orifice cover is made discontinuous by recesses such that the first orifices and second orifices are opened up in the region of the recesses, whereas said orifices are blocked in the region of the orifice cover.

It is furthermore preferable for the first orifices and the second orifices to be arranged relative to one another on the circumference at an angular interval, in each case spaced apart uniformly, and arranged in the correct phase with respect to the orifice cover, such that a relative rotation of the valve piston with respect to the valve housing by the angular interval leads to a geometrically identical arrangement.

The pump mode or the torque mode can preferably be set by means of an axial displacement of a valve piston arranged in a valve housing of the control valve. It is furthermore preferable for the valve housing to have a pump orifice by means of which the supply of pressure medium either to the first chamber part or to the second chamber part can be set such that in each case either the first chamber part or the second chamber part is pressurized, wherein the flow of pressure medium out of the first chamber part or the second chamber part can be set by means of chamber part orifices in the valve housing.

The concept is thus followed of realizing an adjustment by controlling the outflow of pressure medium. Pressure medium is supplied to the chamber parts via the pump orifice in the valve housing, wherein depending on the position of the first orifices or of the second orifices, the pump orifice corresponds to the first chamber part or second chamber part. By opening up the chamber part which is reduced in size in the desired adjustment direction, an outflow of pressure medium from said chamber part is permitted, such that the pressure medium is expelled by the pressure in the other chamber part, and the adjustment is realized.

It is preferable if, for the relative axial position of the valve piston, five switching positions can be set, wherein in a first position, the pump mode is set for an adjustment of the camshaft in the direction of retarded cylinder valve opening times, in the second, axially subsequent switching position, the torque mode is set for an adjustment of the camshaft in the direction of retarded cylinder valve opening times, in the third, axially subsequent switching position, a camshaft adjustment is blocked, in the fourth, axially subsequent switching position, the torque mode is set for an adjustment of the camshaft in the direction of advanced cylinder valve opening times, and in the fifth, axially subsequent switching position, the pump mode is set for an adjustment of the camshaft in the direction of advanced cylinder valve opening times.

These five switching positions thus generally yield adequate adjustment possibilities, in a manner adapted to the respective engine operating state. For example: whereas, when there is adequate pressure from the pressure medium pump, a retardation of the camshaft takes place in switching position one and an advance takes place in switching position five, it is possible in the case of low pressure, utilizing the camshaft torques, for a retardation to take place in switching position two and an advance to take place in switching position four. The middle position, switching position three, can be utilized for a blocking of the adjustment.

A locking mechanism is preferably provided by means of which the camshaft adjuster is mechanically blocked in a locking position so as to be prevented from being adjusted, wherein the locking mechanism can be hydraulically unlocked by the pressure medium, and wherein a supply of pressure medium to the locking mechanism is connected such that the locking device unlocks only when the valve piston is in an axial switching position which corresponds to an adjustment in the direction of advanced cylinder valve opening times.

Locking of a camshaft adjuster is necessary in particular during a shutdown of the engine, such that during a restart, when there is still only an insufficient oil pressure in the adjuster, rattling impacting of the freely movable adjuster elements does not occur. During the shutdown of the engine, therefore, it is generally the case that an adjustment in the retardation direction and locking by means of a locking pin takes place. In a conventional embodiment, the locking pin corresponds to one of the chamber parts, such that after an adequate pressure has built up after an engine start, pressure medium from the chamber parts pushes the hydraulically unlockable locking pin back counter to a spring, and the adjuster is thereby unlocked. In the above-described concept, it is now provided that a separate supply of pressure medium to the locking device is connected such that, during a state corresponding to an adjustment in the retardation direction, no pressure medium passes via the control valve to the locking pin. It is ensured in this way that, after an engine start, the locking mechanism is not unlocked already by a pressure pulse, for example by air forced in by the incoming pressure medium. Since the base position is set retarded, the adjuster must first be unlocked when the rotational position of the camshaft is to be changed, that is to say in the event of an adjustment in the advance direction. For this purpose, the valve piston is moved axially from the basic position. By virtue of the fact that the supply preferably corresponds to locking orifices in the camshaft which are arranged at the same level as the second orifices in the axial direction but spaced apart from the second orifices in the circumferential direction, it can now be achieved that the supply is first opened up, and pressure medium thus passes to the locking pin, in a switching position in the advance direction. It is furthermore preferable for this purpose for two locking orifices to be arranged in the circumferential direction between in each case two second orifices.

BRIEF DESCRIPTION OF THE DRAWINGS

Further features of the invention will emerge from the following description and from the drawings, which illustrate exemplary embodiments of the invention in simplified form. In the drawings.

DETAILED DESCRIPTION OF THE PREFERRED EMBODIMENTS

Figure 1:
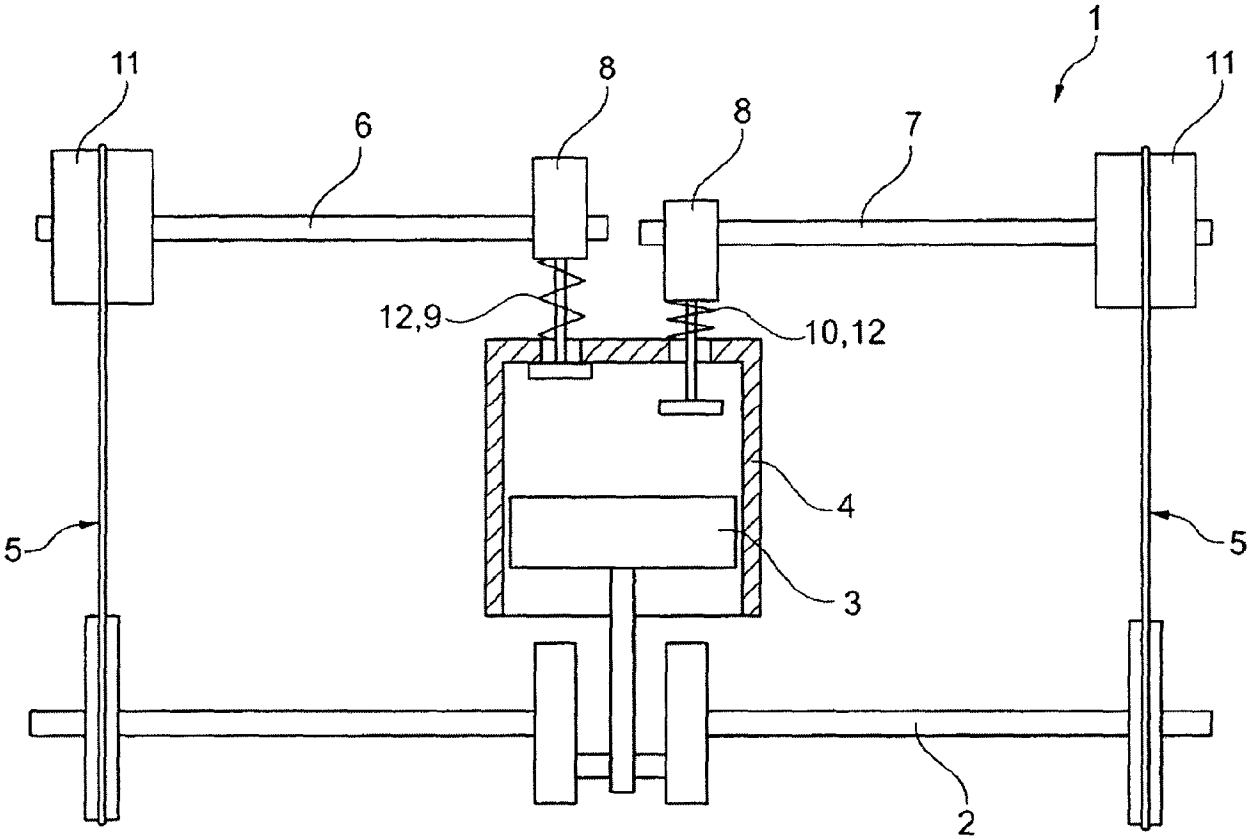
FIG. 1 shows, merely highly schematically, an internal combustion engine.

FIG. 1 illustrates an internal combustion engine 1, with a piston 3 which is seated on a crankshaft 2 being indicated in a cylinder 4. In the illustrated embodiment, the crankshaft 2 is connected via in each case one traction mechanism drive 5 to an intake camshaft 6 and an exhaust camshaft 7, wherein a first and a second camshaft adjuster 11 for variably adjusting the timing of gas exchange valves 9, 10 of an internal combustion engine can effect a relative rotation between the crankshaft 2 and the camshafts 6, 7. Cams 8 of the camshafts 6, 7 actuate one or more intake gas exchange valves 9 or one or more exhaust gas exchange valves 10. The intake gas exchange valves 9 and the exhaust gas exchange valves 10 will hereinafter be referred to for short as cylinder valves 12. It may likewise be provided that only one of the camshafts 6, 7 is equipped with a device 11, or only one camshaft 6, 7 is provided, which is equipped with a camshaft adjuster 11. Intake camshaft 6 and exhaust camshaft 7 will hereinafter be summarized under the expression "camshaft 35".

Figure 2:
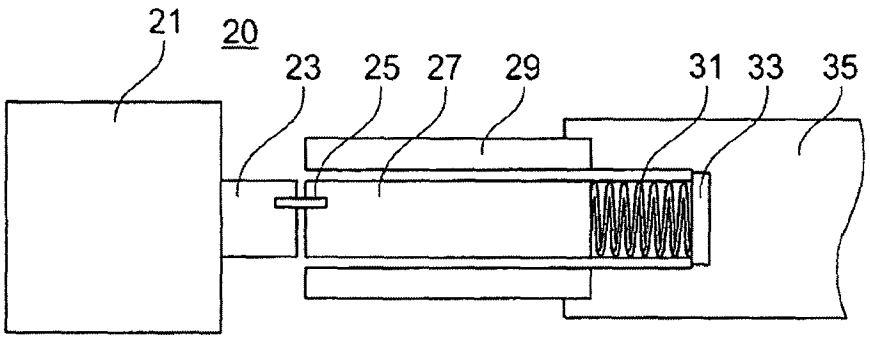
FIG. 2 is a schematic illustration of a control valve.

FIG. 2 is a schematic illustration of a control device 20. The control device 20 comprises a valve housing 29 and a valve piston 27 arranged therein. In the example shown, the control valve 20 is arranged with one end in a camshaft 35. There, the valve piston 27 is acted on by a restoring spring 31. The restoring spring 31 is mounted by means of an axial bearing arrangement 33 in the form of a rolling bearing. The valve piston 27 is connected, at its end remote from the camshaft 35, to a magnet piston 23 which can be moved axially by an electromagnet 21. A rotation prevention means 25 connects the magnet piston 23 to the valve piston 27 such that the latter cannot rotate. It is self-evidently also conceivable for an axial movement to be performed by the valve housing 29 and a rotational movement to be performed by the valve piston 27, with a correspondingly changed configuration of the surroundings.

Figure 3:
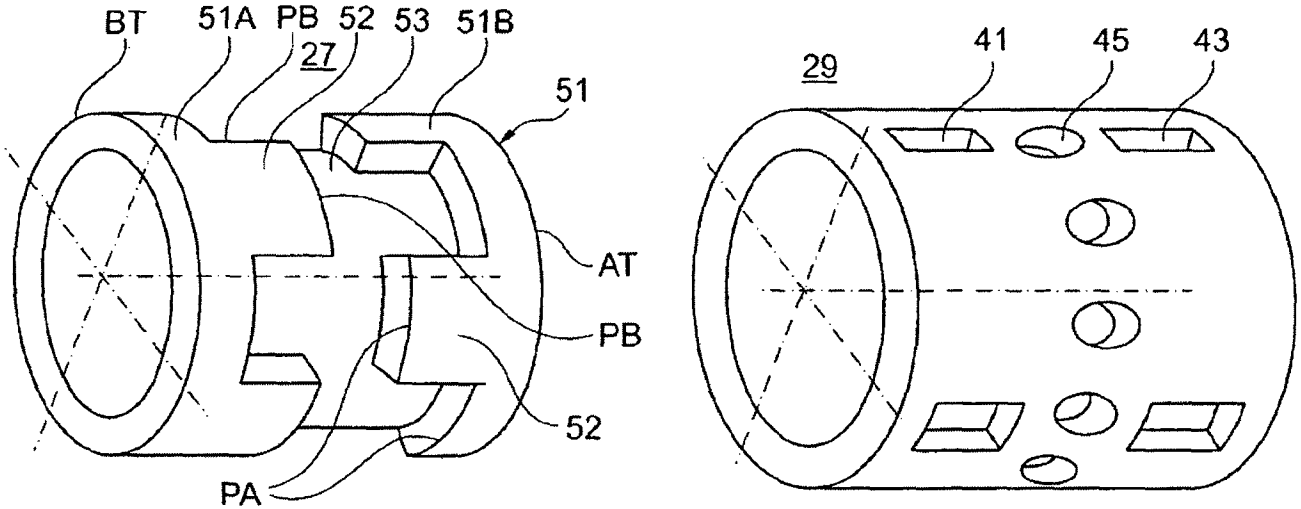
FIG. 3 shows a valve piston and a valve housing.

FIG. 3 shows the valve piston 27 and the valve housing 29 in a perspective view. The valve housing 29 has first orifices 41 distributed about its circumference. Arranged axially offset with respect to the first orifices 41 and approximately in the center of the valve housing 29 are circumferentially distributed third orifices 45. Following these with an axial offset are, in turn, second orifices 43 which are arranged at the same position in the circumferential direction as the first orifices 41. The valve piston 27 is inserted in the correct rotational position into the hollow valve housing 29. The valve piston 27 has, on its surface 53, an orifice cover 51 which is formed by a radially elevated part of the surface 53. The orifice cover has, at one axial end of the valve piston 27, a first cover part 51A, and at the opposite end, a second cover part 51B. The two cover parts 51A, 51B are of crown-like design, that is to say they form a ring around the surface 53 with a respective outer edge BT, AT. The outer edge BT of the first cover part 51A simultaneously forms one axial end of the valve piston 27, whereas the outer edge AT of the second cover part 51B simultaneously forms the other axial end of the valve piston 27. That inner edge PB, PA of the cover parts 51A, 51B which is directed axially toward the center of the surface 53 has a rectangular serration. Here, in each case one crown serration 52 of a cover part 51A, 51B is oriented in the circumferential direction so as to lie between two crown serrations 52 of the other cover part 51B, 51A, wherein there is however an axial spacing between the inner edges PB, PA.

The valve piston 27 should now be arranged in the valve housing 29 in the correct rotational position such that the orifice cover 51 opens up and blocks the first orifices 41 and second orifices 43, respectively, for the correct phase position in each case. A supply of pressure medium to chamber parts of a pressure chamber, and therefore also the adjustment of the phase position of the camshaft, is controlled in this way. This will be explained in detail further below.

Figure 4:
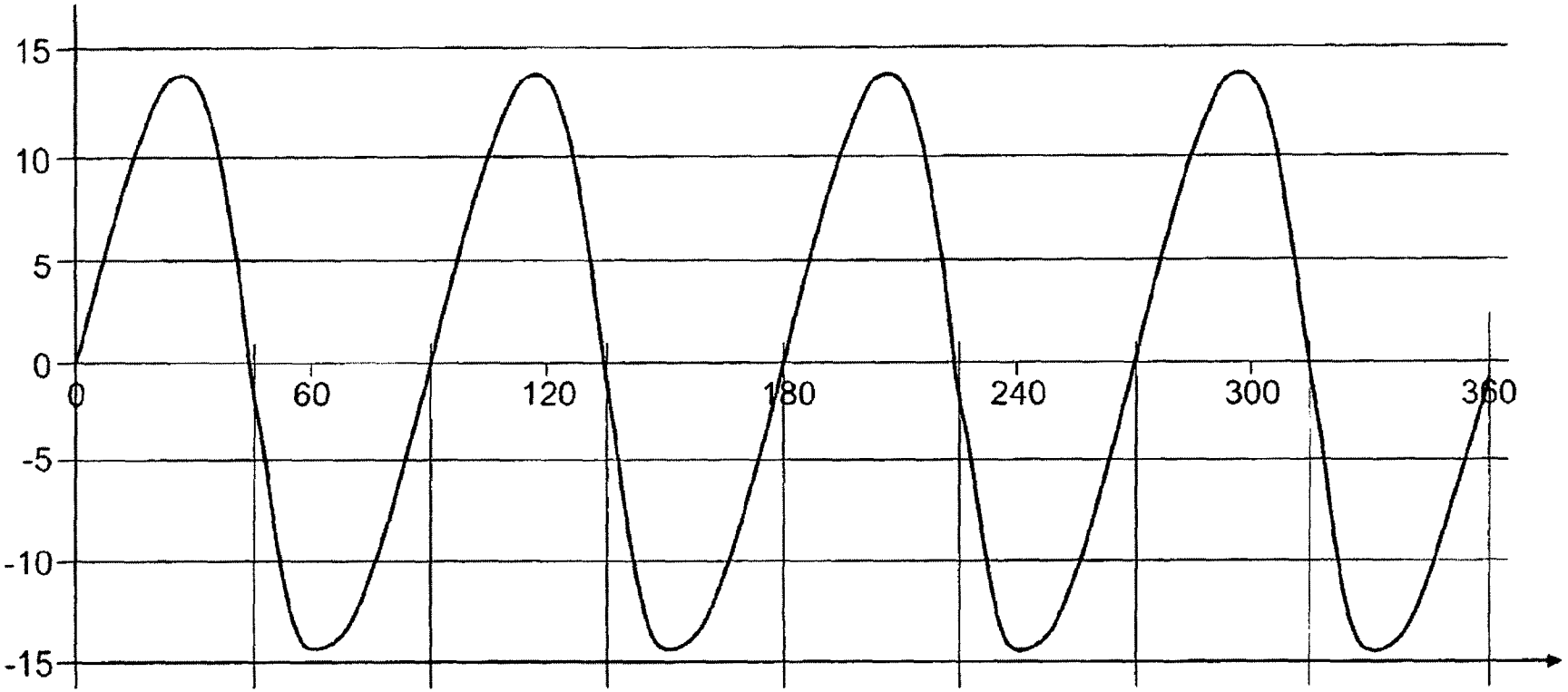
FIG. 4 is an illustration of the camshaft torques as a function of the rotational angle of the camshaft.

FIG. 4 shows, based on the example of a four-cylinder engine, the profile of the camshaft torques, plotted in the y direction, versus the rotational position of the camshaft, plotted in the x direction. A constant torque resulting from friction of the camshaft at a constant rotational speed is neglected here. Camshaft torques greater than zero correspond to a torque in the direction of an advance, that is to say in a direction which leads to earlier opening of the cylinder valves 12. Camshaft torques less than zero correspond to a torque in the direction of a retardation, that is to say in a direction which leads to later opening of the cylinder valves 12. It can be seen that the camshaft torques have an approximately sinusoidal profile as a function of the rotational position of the camshaft. At fixed angular positions in each case, advance torques arise, which alternate with retardation torques. This is now utilized in a targeted manner for the adjustment of the camshaft.

Figure 5:
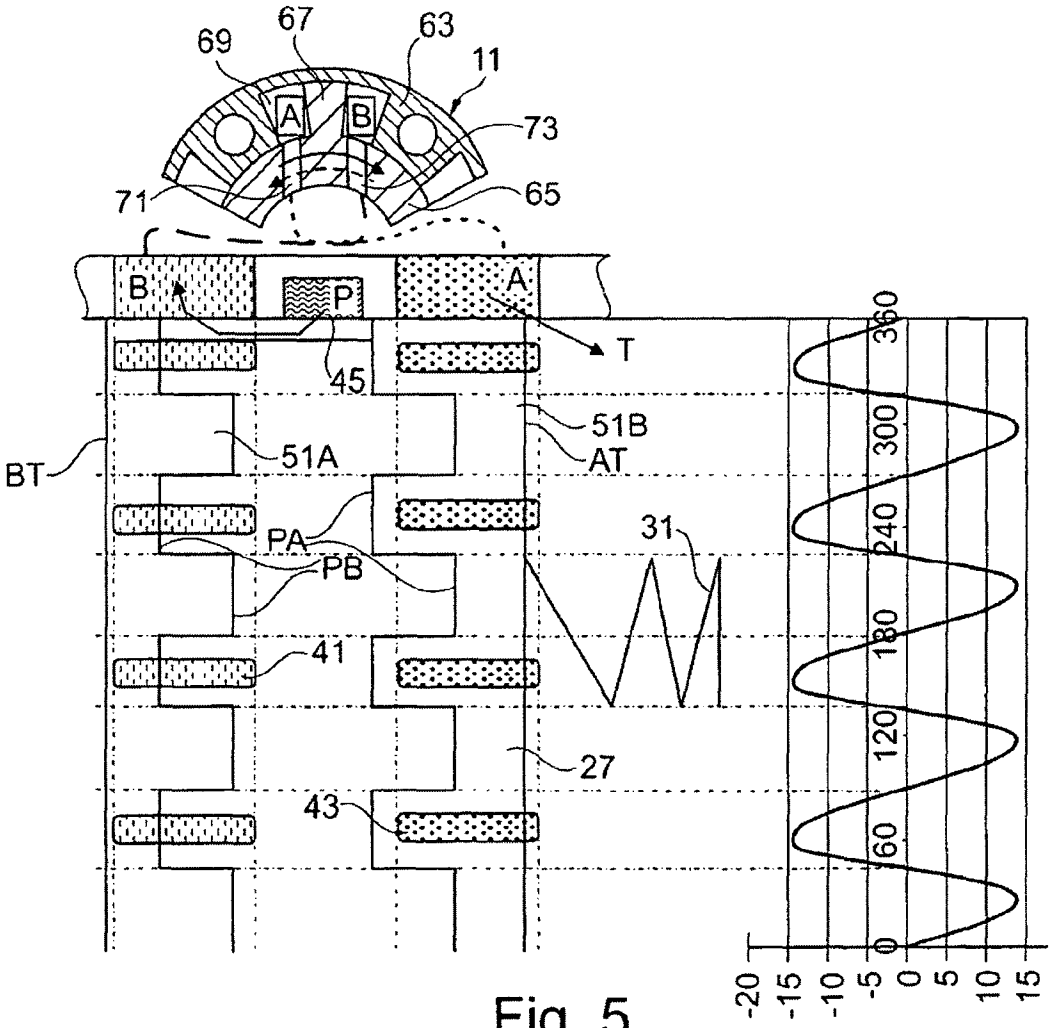
FIGS. 5-14 are schematic illustrations of the different switching positions in the case of an OPA method.

In FIG. 5, a switching position for the adjustment of the camshaft is schematically plotted such that the orifice cover 51 of the valve piston 27 is illustrated in a developed view in a plane. The first cover part 51A thus yields a rectangular profile with the inner edge PB and a straight outer edge BT. Illustrated opposite, then, is the second cover part 51B with the inner edge PA and the outer edge AT. At the outer edge AT, the valve piston 27 is connected to the restoring spring 31, which presses the valve piston 27 against a magnet 21 (not illustrated here).

Also schematically illustrated are the first orifices 41 and the second orifices 43, as they are arranged relative to the orifice cover 51 corresponding to the axial position and rotational position of the valve housing 29 relative to the valve piston 27. The first orifices 41 correspond to a second chamber part B, and the second orifices 43 correspond to a first chamber part A. The chamber parts A, B are divided by a vane 67 which forms an adjustment means 67 and which divides a pressure chamber 69 into the chamber parts A, B. The vane 67 is connected to a rotor 65 of a camshaft adjuster 11. The pressure chamber 69 is formed in a stator 63 of the camshaft adjuster 11. A first oil channel 71 leads to the first chamber part A, a second oil channel 73 leads to the second chamber part B. Only a detail of the camshaft adjuster 11 is shown here. The camshaft adjuster 11 is designed as a vane-type adjuster and has a plurality of pressure chambers, chamber parts, vanes and supply channels, which are not illustrated here for the sake of clarity.

In the example of FIG. 5, an adjustment of the camshaft takes place in the direction of later opening times of the cylinder valves 12: pressurized oil is supplied to the second chamber part B and is discharged from the first chamber part A. In the switching position shown here, the first cover part 51 substantially opens up the first orifices 41 by means of the inner edge PB, such that pressurized oil passes from a pump P via the third orifices 45 in the valve housing 29 to the second chamber part B. At the same time, the second orifices 43 are opened up slightly by the outer edge AT of the second cover part 51B, such that oil can be discharged from the first chamber part A into a tank T. The pressure difference thus generated between the chamber parts A, B leads to a force being exerted on the vane 67 and therefore on the rotor 65 in a rotational direction to the left. The rotor 65 is connected to the camshaft 35. The camshaft 35 is thus rotated in the "retardation" direction.

As a result of the great extent to which the first orifices 41 are opened up, intense dethrottling is attained, as a result of which the risk of air induction is greatly reduced. Discharge control is realized through the lesser opening-up of the second orifices 43 to the tank.

FIG. 5 shows, on the right adjacent to the schematic illustration of the valve piston 27 and the first and second orifices 41, 43 of the valve housing, the profile, known from FIG. 4, of the camshaft torques as a function of the rotational angle of the camshaft 35. The valve housing 29 and therefore the first and second orifices 41, 43 now rotate in a defined manner relative to said camshaft profile, as shown by the juxtaposition. The first and second orifices in FIG. 5 are therefore precisely synchronous with a retardation camshaft torque. This has the effect that the second orifices 43 receive a pressure peak in the direction of a retardation, as a result of which the oil situated in the first chamber part A can be quickly discharged. Furthermore, the oil pressure of the pump P acts via the widely opened, intensely dethrottled first orifices 41 into the second chamber part B. The result is a very fast adjustment of the camshaft 35. A fast adjustment in the advance direction is also realized in a corresponding way.

Figure 6:
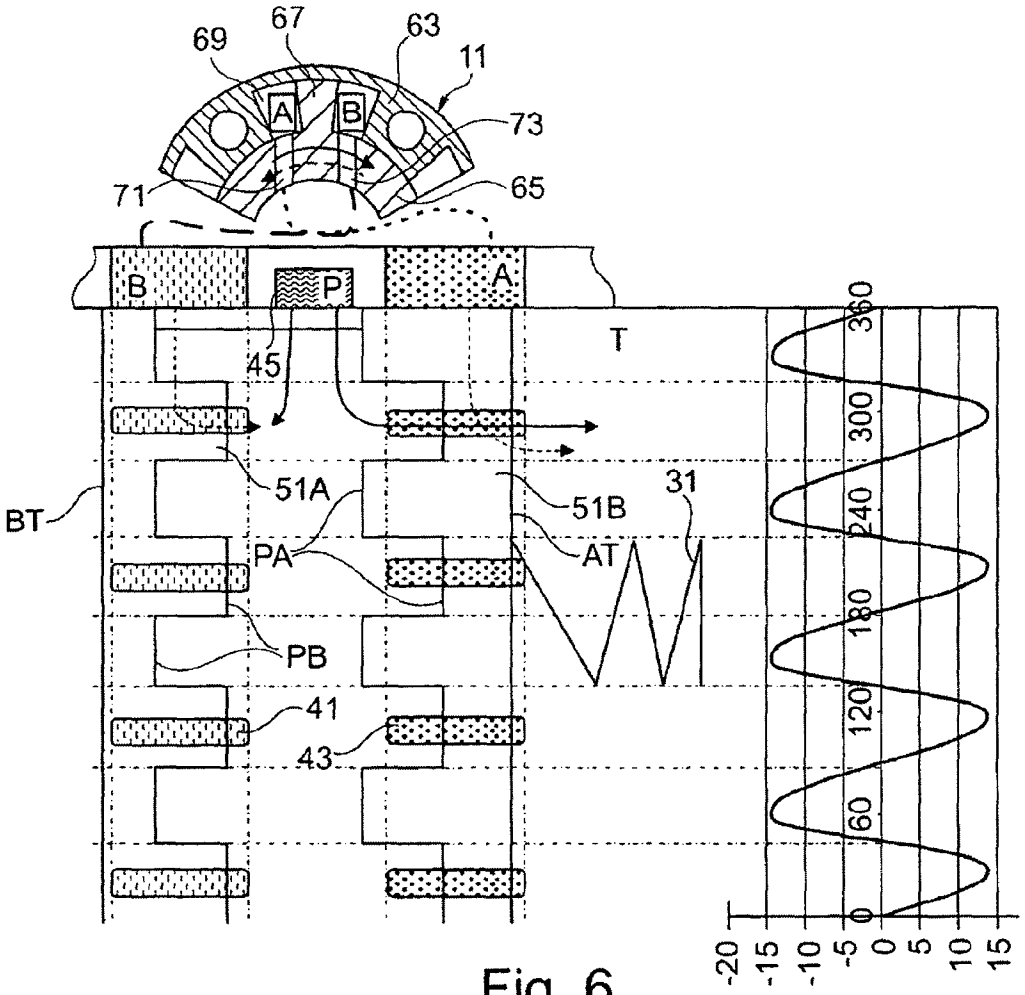

FIG. 6 shows an image corresponding to FIG. 5, but here, the first and second orifices 41, 43 have been rotated relative to the orifice cover 51. This corresponds in terms of time to the occurrence of an advance camshaft torque. The first orifices 41 are opened up only to a small extent by the first cover part 51A, whereas the second orifices 43 are opened up to a great extent for the supply of pressure from the pump P. The pump P acts on both chamber parts A, B. In chamber part B, said pump now acts counter to an advance torque, as a result of which compensation is substantially attained, and no adjustment takes place. Chamber part A is traversed by a flow of pressure medium and emptied into the tank T.

Figure 7:
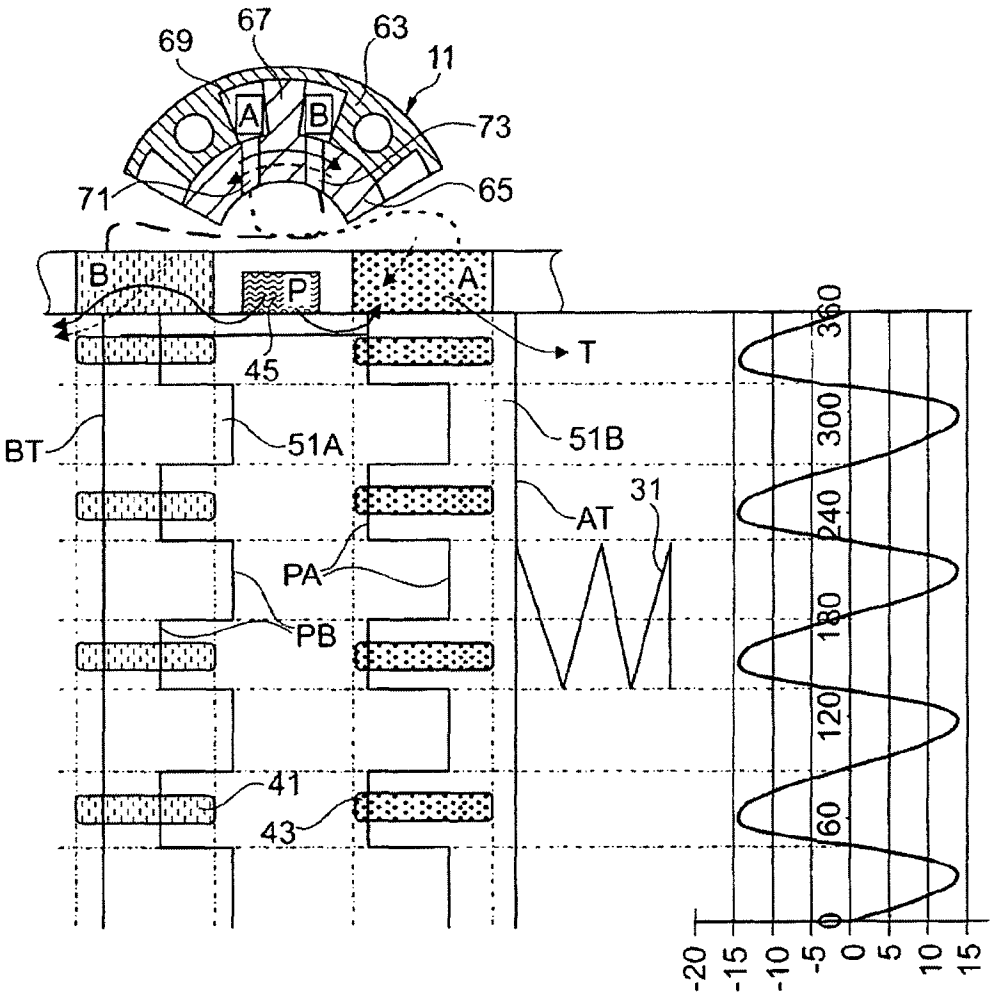
Figure 8:
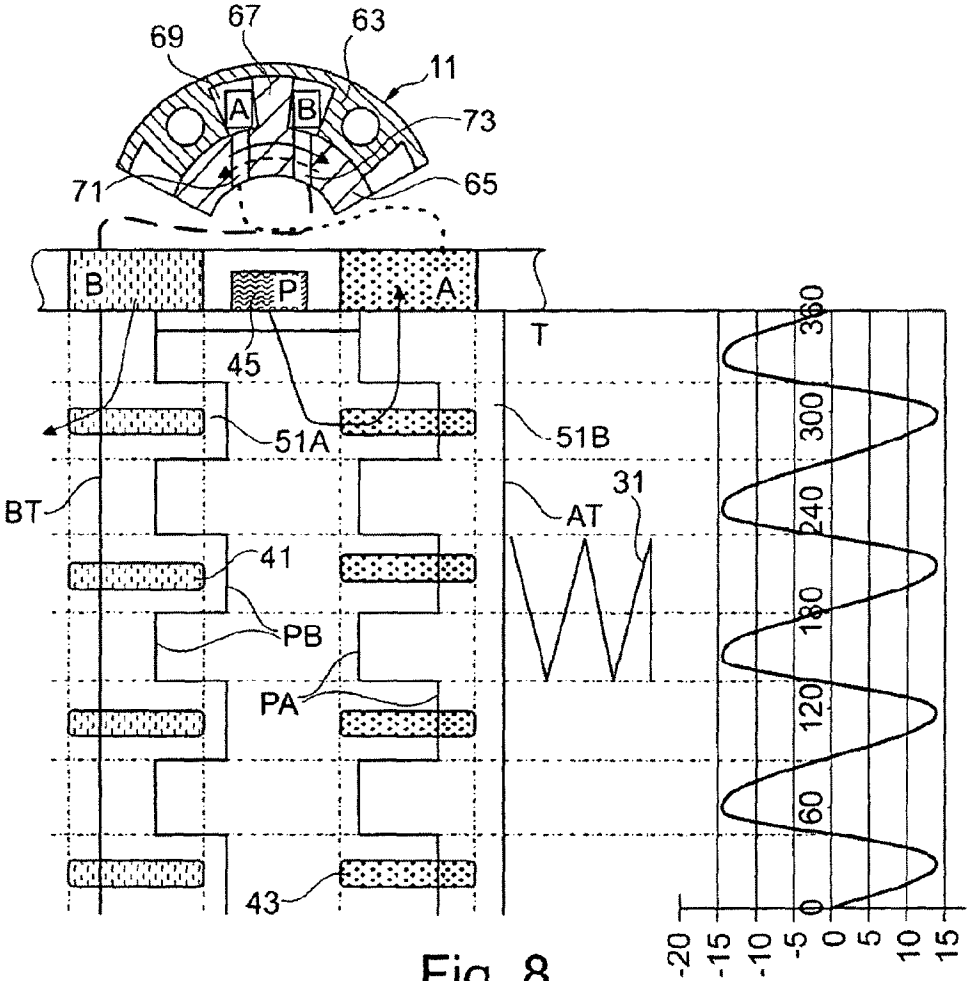

FIGS. 5 and 6 show a switching position for a "retardation" adjustment, in which an adjustment method based on the "oil pressure actuated" (OPA) principle is realized, specifically in a retardation adjustment direction. This switching position, which thus predominantly utilizes the adjustment force of the pump and in which camshaft torques have merely an assisting action, is realized by means of the illustrated axial position of the valve piston 27. The axial switching position is set by means of the magnet 21. In the example shown, this is the basic position without energization of the electromagnet 21. As explained, in the axial switching position, different rotational positions of the valve piston 27 relative to the valve housing 29 are realized, and in this way the corresponding camshaft torques are additionally utilized. FIGS. 7 and 8 show the corresponding illustration for an "advance" adjustment. Here, the actions for the chamber parts A, B are interchanged, but otherwise the explanations made with regard to FIGS. 5 and 6 apply analogously.

Figure 9:
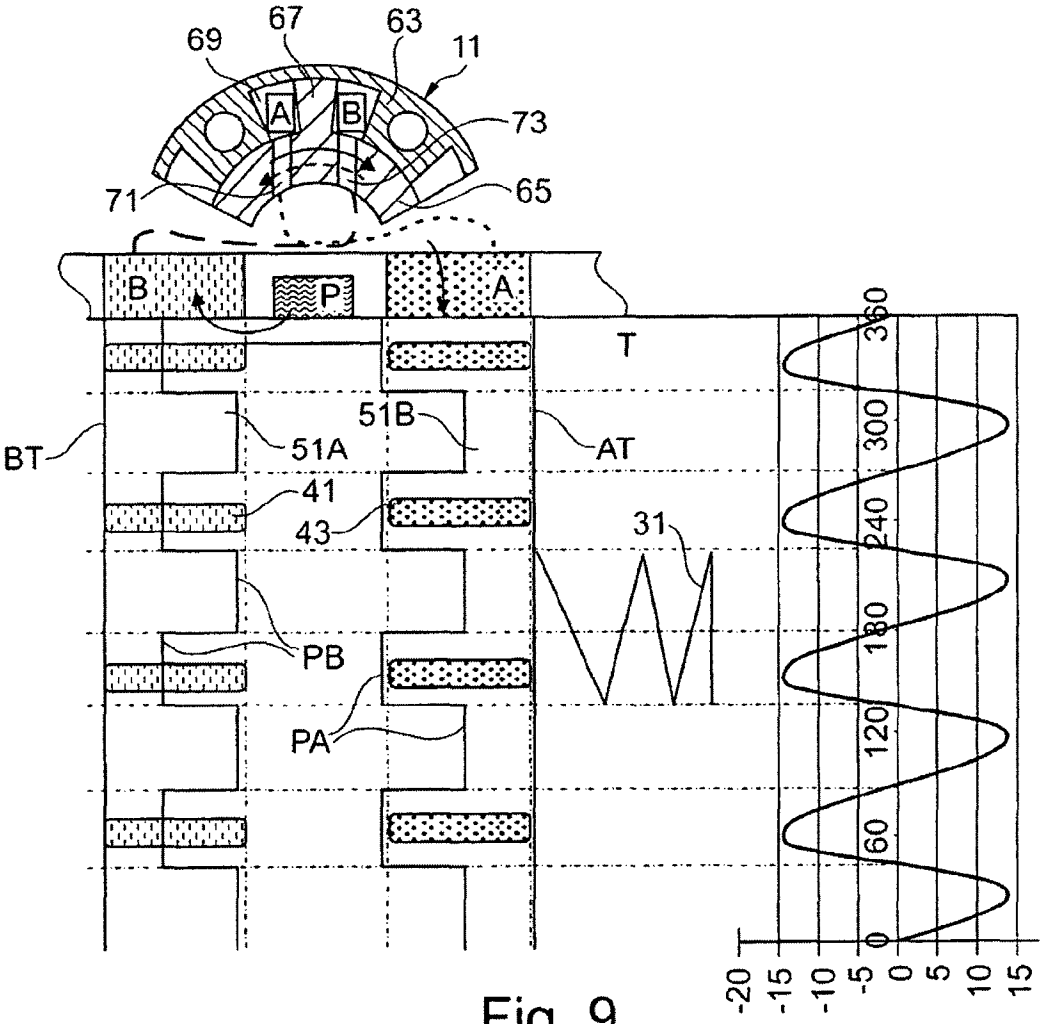
Figure 10:
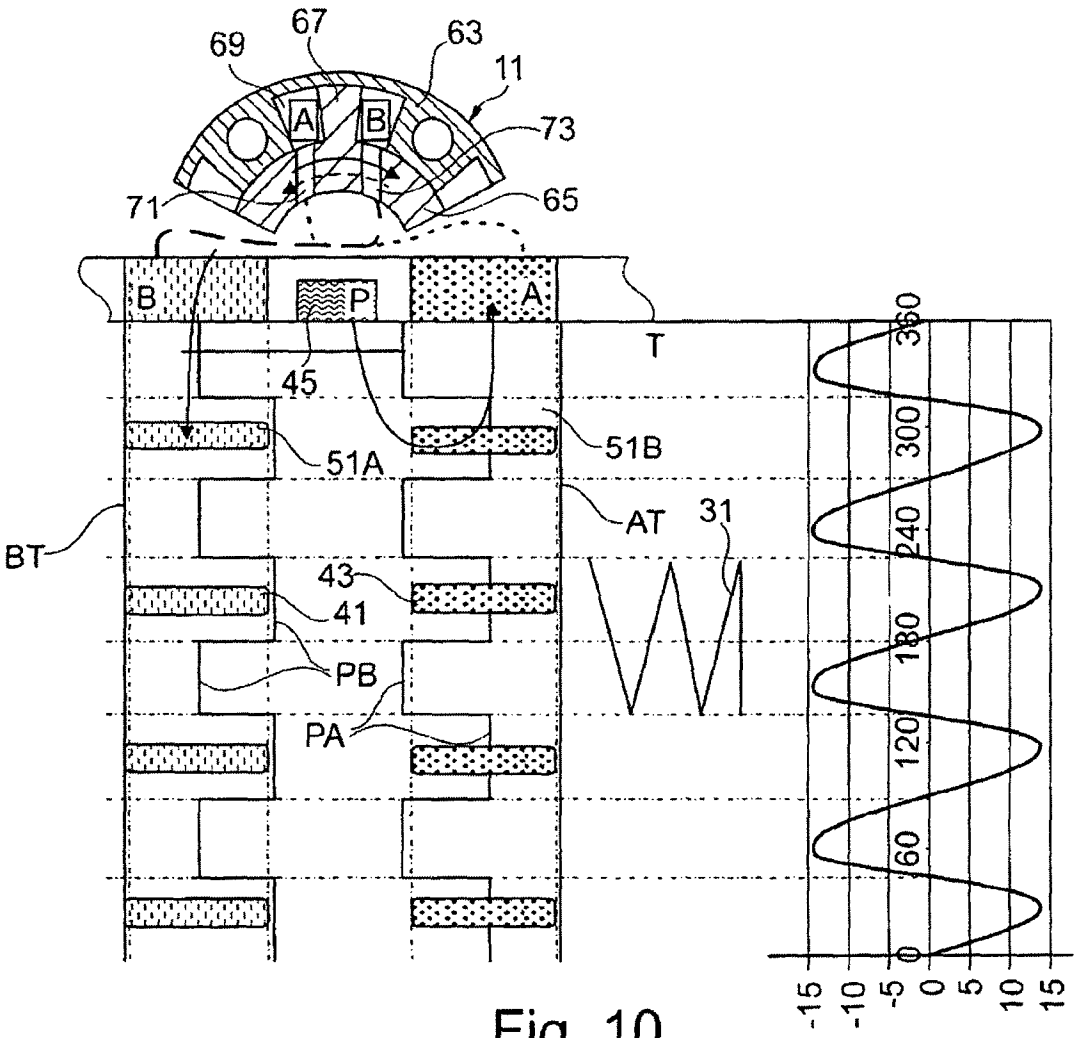

FIG. 9 shows an intermediate position in which, upon the occurrence of a retardation torque, the second orifices 43 are completely blocked. In this way, an adjustment is blocked. Correspondingly, FIG. 10 shows complete blocking of the first orifices 41 upon the occurrence of an advance torque. FIGS. 9 and 10 therefore depict an axial switching position of the valve piston 27 in which an adjustment of the camshaft 35 should be prevented, that is to say said camshaft should be held in a defined relative angular position with respect to the crankshaft.

FIGS. 5 to 10 show switching positions in which a high pressure of the pump P is available, that is to say generally an operating state of the internal combustion engine at high rotational speeds. If, however, the available pressure of the pump P is not high, in particular is considerably lower than the pressure exerted by camshaft torques, a suitable OPA method can be set through the selection of further switching positions. This will be described on the basis of FIGS. 11-14.

Figure 11:
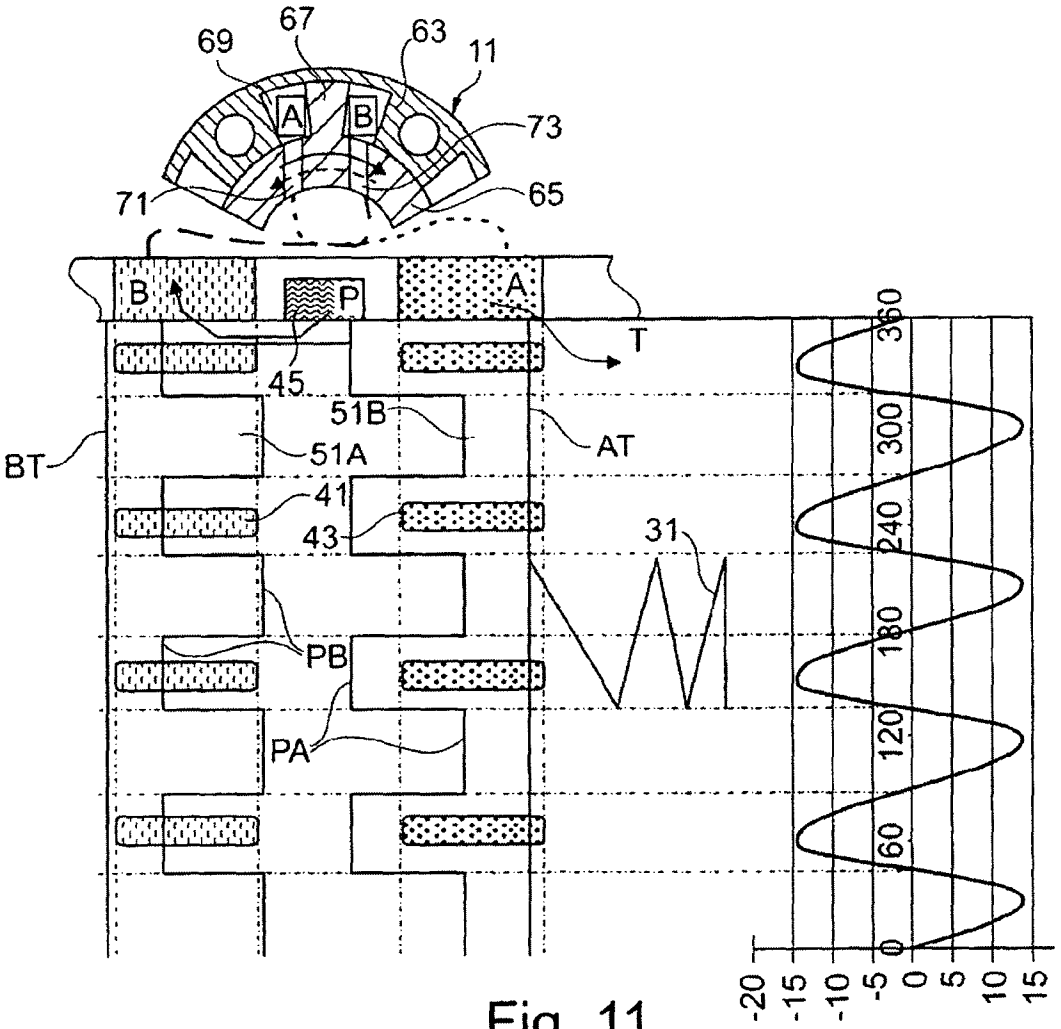
Figure 12:
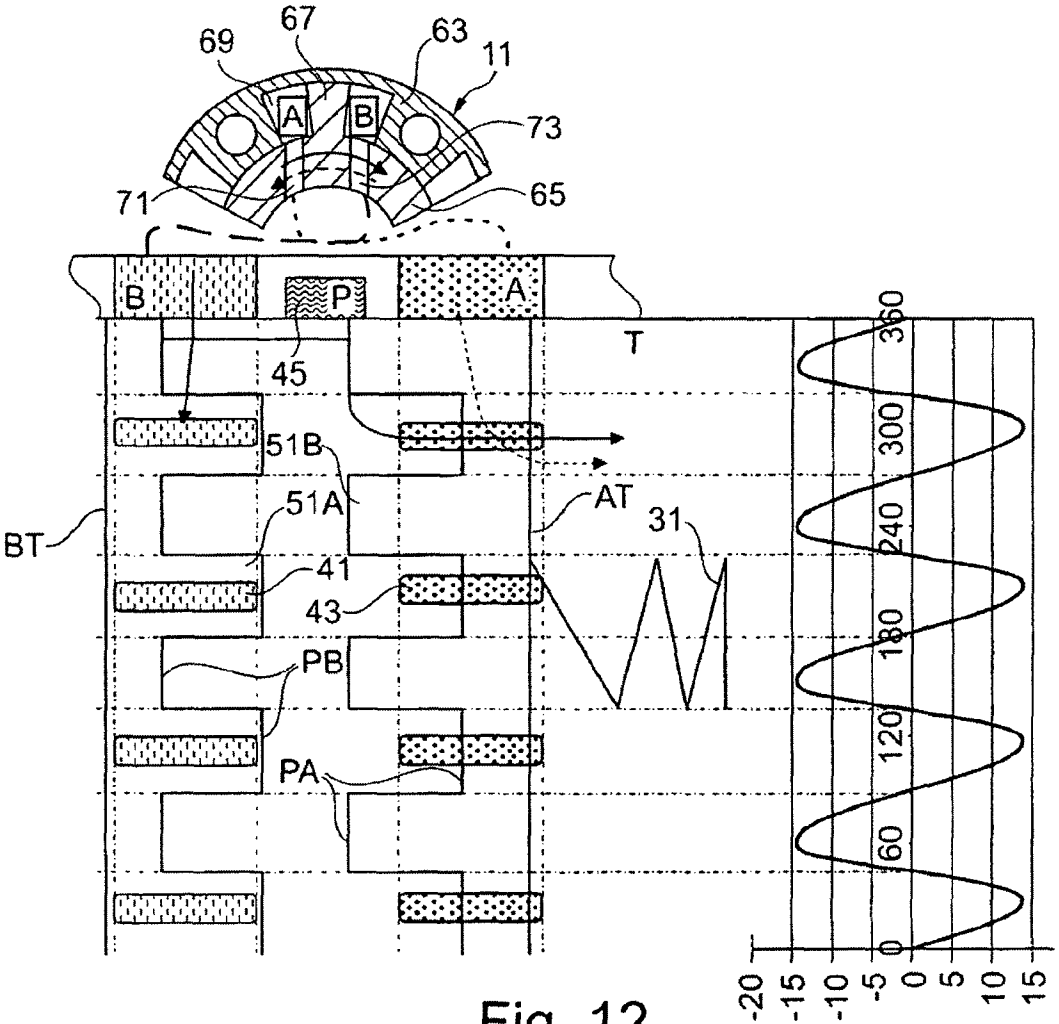

FIG. 11 corresponds to FIG. 5. It is thus sought to realize an adjustment in the "retardation" direction. Here, the retardation torque aids the adjustment. In FIG. 12, upon the occurrence of an advance torque, it is clear that, owing to the axial position of the valve piston 27 which has now changed in relation to FIG. 6, complete coverage of the first orifices 41 is attained. Whereas, therefore, in FIG. 6 only a high pump pressure was available for compensating the advance torque with the first orifices 41 slightly open, in the case of a low pump pressure the advance torque is suppressed by a complete blockage of the first orifices 41. FIGS. 13 and 14 again show the corresponding illustration in the case of an "advance" adjustment.

The switching positions illustrated above can thus be summarized as follows: two OPA adjustment methods are provided, one in the case of low pump pressure and one in the case of high pump pressure. The axial switching positions can be abbreviated as follows:

Switching position I: high pump pressure, retardation adjustment, FIGS. 5, 6

Switching position II: low pump pressure, retardation adjustment, FIGS. 11, 12

Switching position III: blocked adjustment, FIGS. 9, 10

Figure 13:
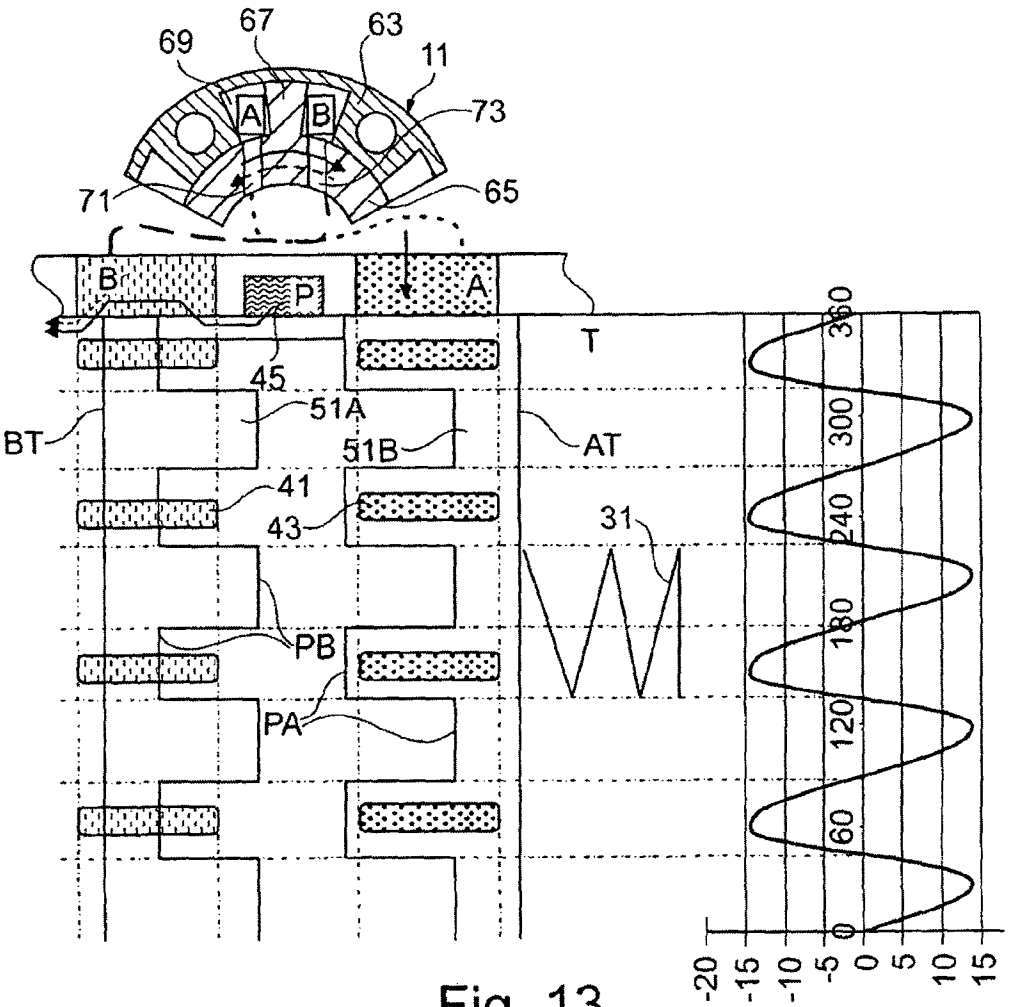
Figure 14:
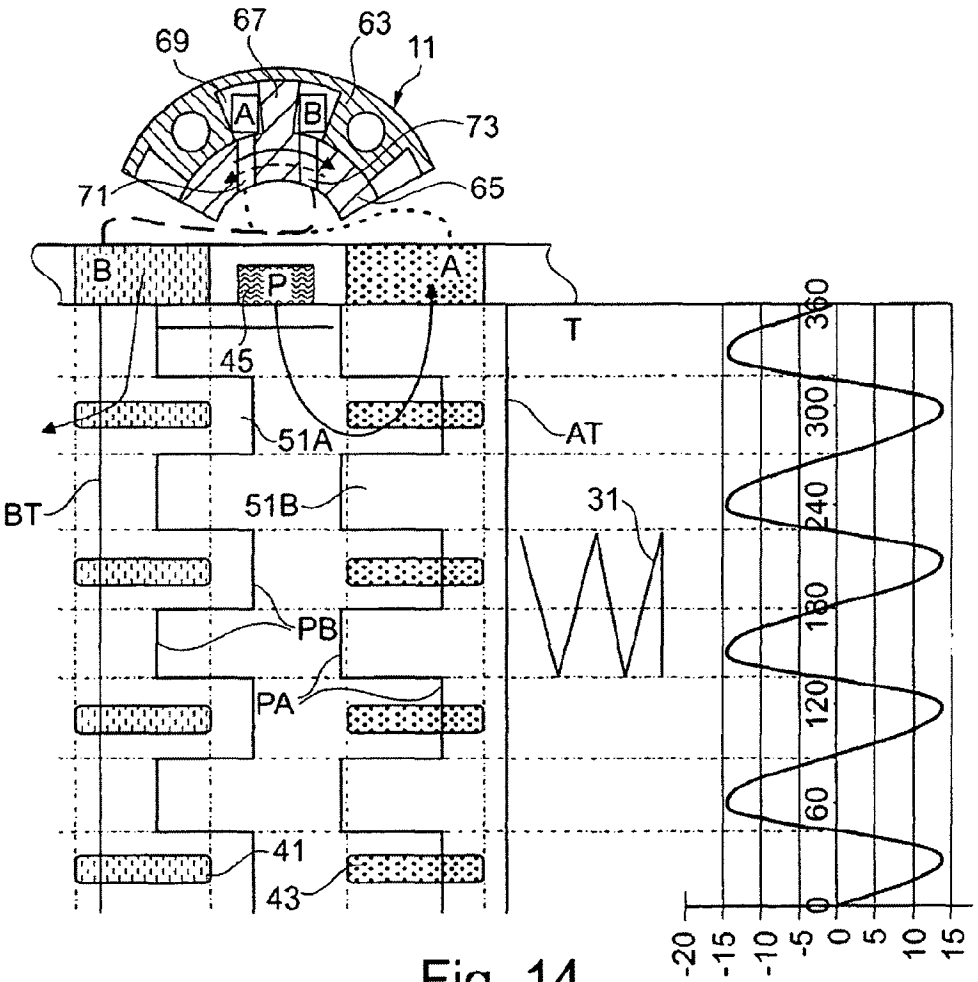

Switching position IV: low pump pressure, advance adjustment, FIGS. 13, 14

Switching position V: high pump pressure, advance adjustment, FIGS. 7, 8

The advantage of said adjustability lies in particular in the fact that, by means thereof, in the case of high pump pressure and a torque which counteracts the desired adjustment direction, the inflow openings 41 and 43 to the respective chamber parts A, B are not fully closed, as a result of which the pump power, which is higher than the relatively low camshaft torque, can nevertheless still be utilized for adjustment despite the oppositely acting camshaft torque. The times at which oppositely acting camshaft torques arise can thus be utilized for the adjustment, resulting in a fast adjustment. If, however, the pump power is lower than the camshaft torques, the oppositely acting torques are suppressed by means of the completely closed orifices 41 and 43, such that no reverse adjustment takes place.

Figure 15:
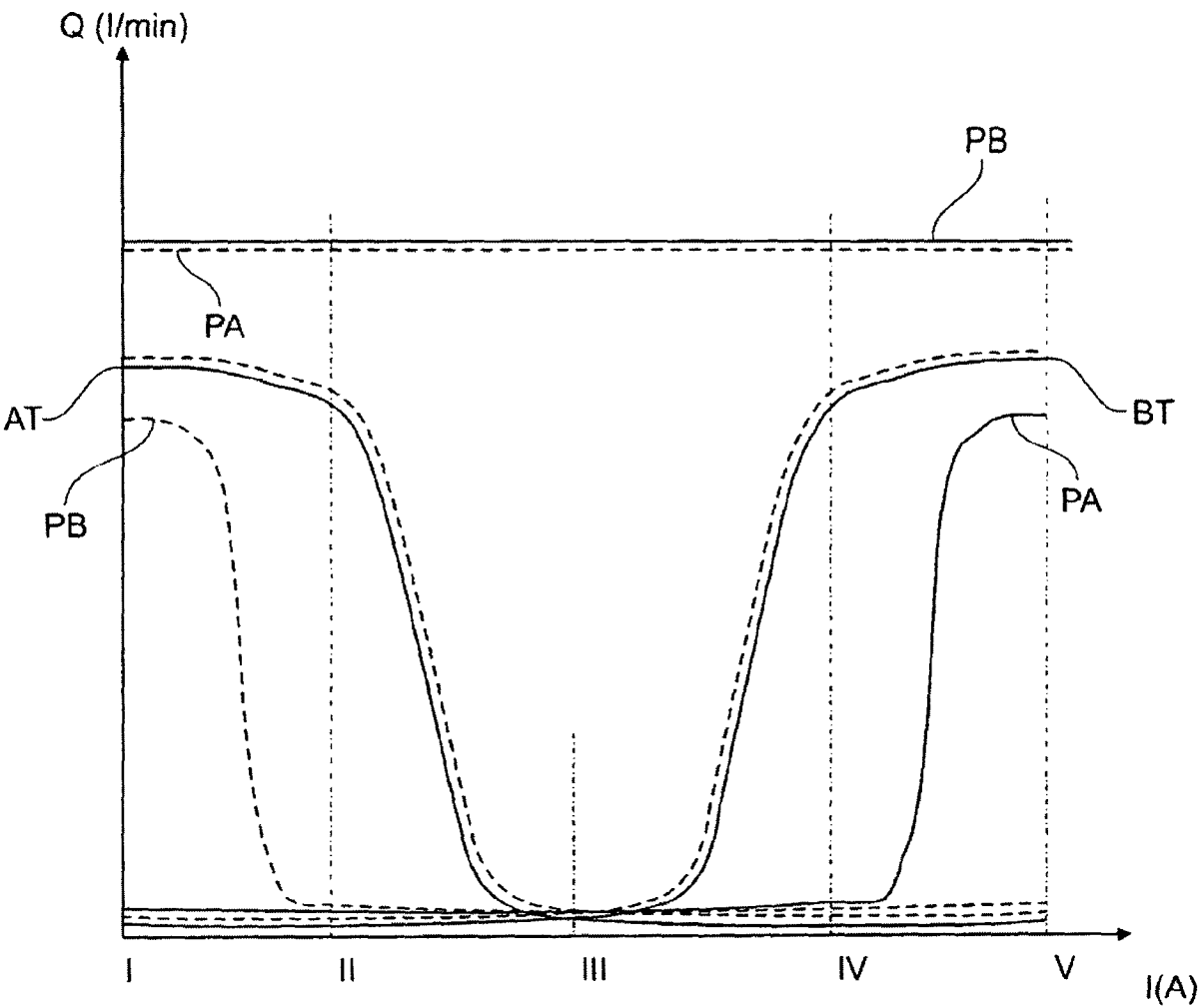
FIG. 15 is an illustration of the change in flow rates at different control edges as a function of the switching position in the OPA method.

FIG. 15 illustrates how the throughflow of pressure medium at the respective inner and outer edges PA, PB, BT, AT changes as a function of the switching position. Here, dashed lines illustrate profiles at times with a camshaft torque in the advance direction, and solid lines illustrate profiles at times with camshaft torques in the retardation direction. The line for the inner edge of the first cover part 51A, PB, will be explained by way of example: In the case of camshaft torques in the retardation direction, the throughflow at the inner edge PB is high in all axial positions, whereas in the case of torques in the advance direction, from switching position I to switching position II and subsequent switching positions, said throughflow falls quickly to zero.

Figure 16:
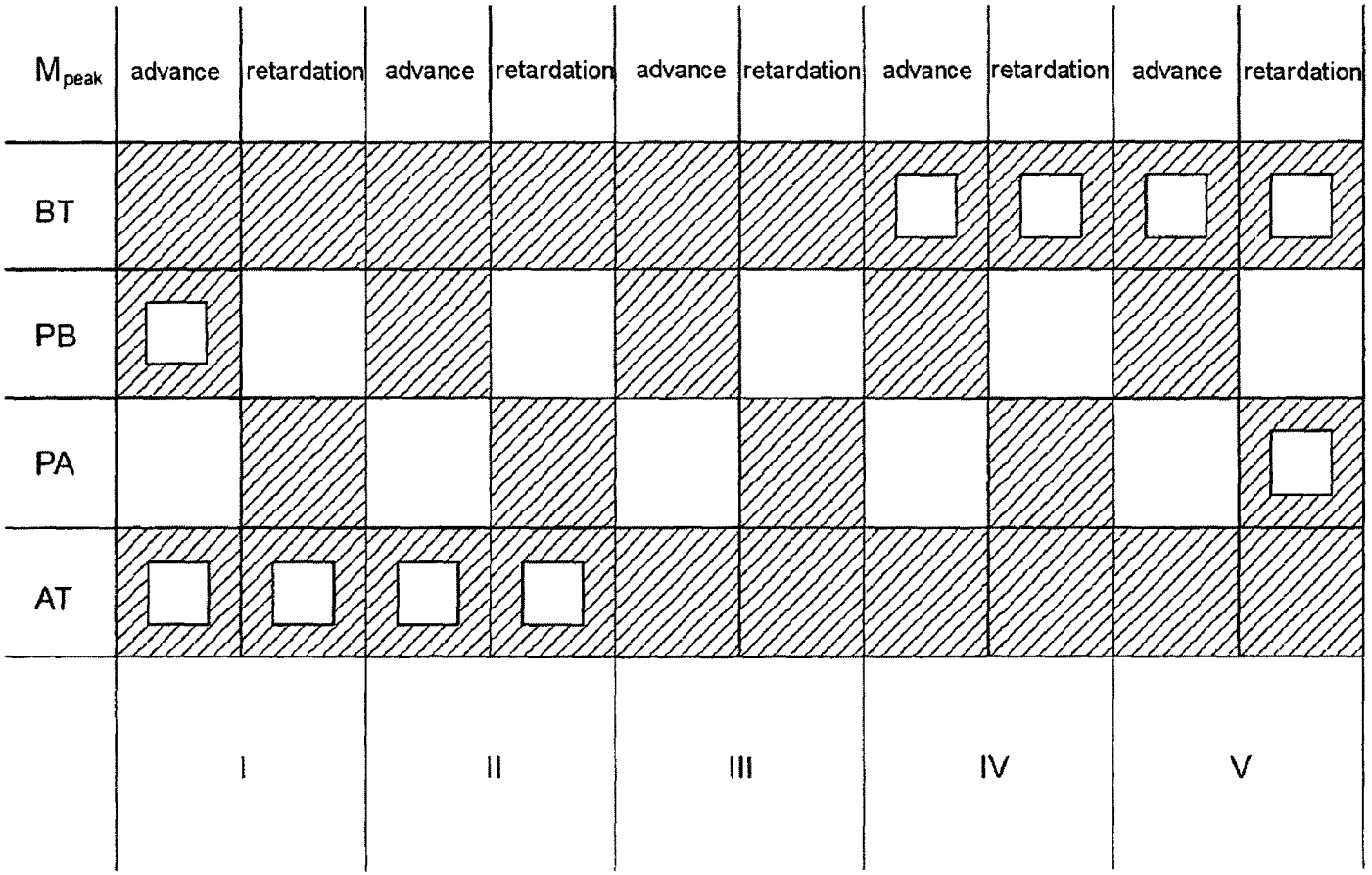
FIG. 16 is an illustration of the opening of the control edges as a function of the switching position in the OPA method.

FIG. 16 schematically shows, for switching positions I-V, the degree of opening of the orifices 41, 43 as viewed from the respective inner edges PB, PA and outer edges BT, AT as a function of the switching positions I-V and the adjusting direction. Fully hatched fields correspond to a completely blocked orifice 41, 43, fully white fields correspond to a completely open orifice 41, 43, and partially hatched fields correspond to a partially blocked orifice 41, 43.

The statements made up to this point relate to an adjustment method in which adjustment is carried out predominantly by means of the pressure provided by the pump P and in which pressure generated by camshaft torques has an assisting action in suitable switching positions. It is now sought below to describe, in addition to a pump mode of said type, a torque mode in which predominantly the pressure peaks generated by camshaft torques are utilized for adjustment, while the pressure provided by the pump P possibly assists the adjustment.

Figure 17:
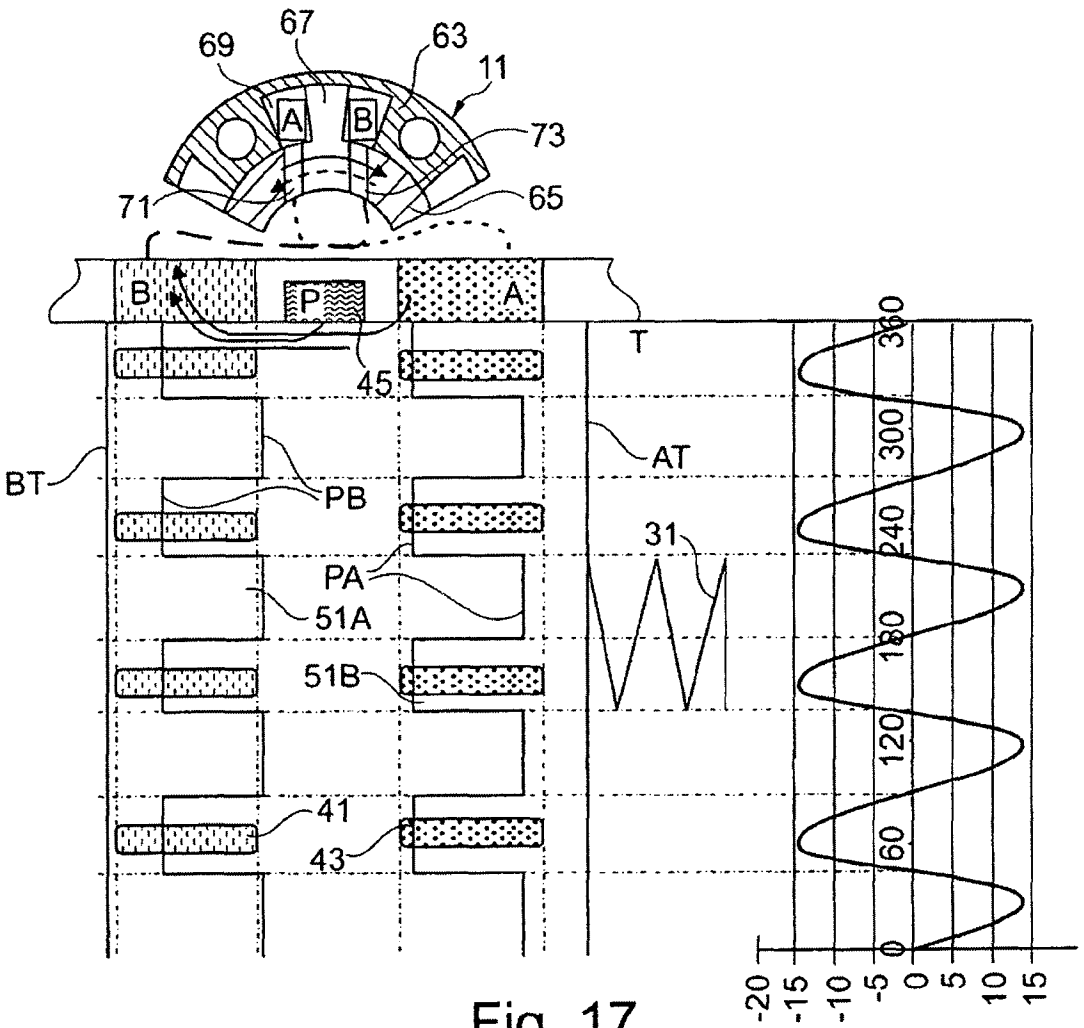
FIGS. 17-20 are schematic illustrations of the different switching positions in the case of a CTA method.

FIG. 17 shows an illustration corresponding to the illustrations of FIGS. 5-14, for the purpose of explaining a retardation adjustment by means of the utilization of the retardation torques. Here, the orifice cover 51 is set by means of the axial position of the valve piston 27 such that, upon the occurrence of a retardation torque, a connection of the two chamber parts A and B is created via the first and second orifices 41, 43. Here, the first orifices 41 are opened to a great extent, such that intense dethrottling, and therefore a low risk of air induction, are again attained. The second orifices 43 are opened to a small extent in order to realize discharge control from the first chamber part A. As a result of the camshaft torque which causes rotation in the retardation direction, a pressure peak is now built up which, by means of the different opening ratios of the first and second orifices 41, 43, generates a higher pressure in the first chamber part A than in the second chamber part B, and therefore, with a displacement of oil from the first chamber part A into the second chamber part B, causes a displacement of the vane 67 and therefore an adjustment of the camshaft 35 in the retardation direction. Oil from the pump P which arrives via the third orifices 45 assists said adjustment and compensates for leakage losses.

Figure 18:
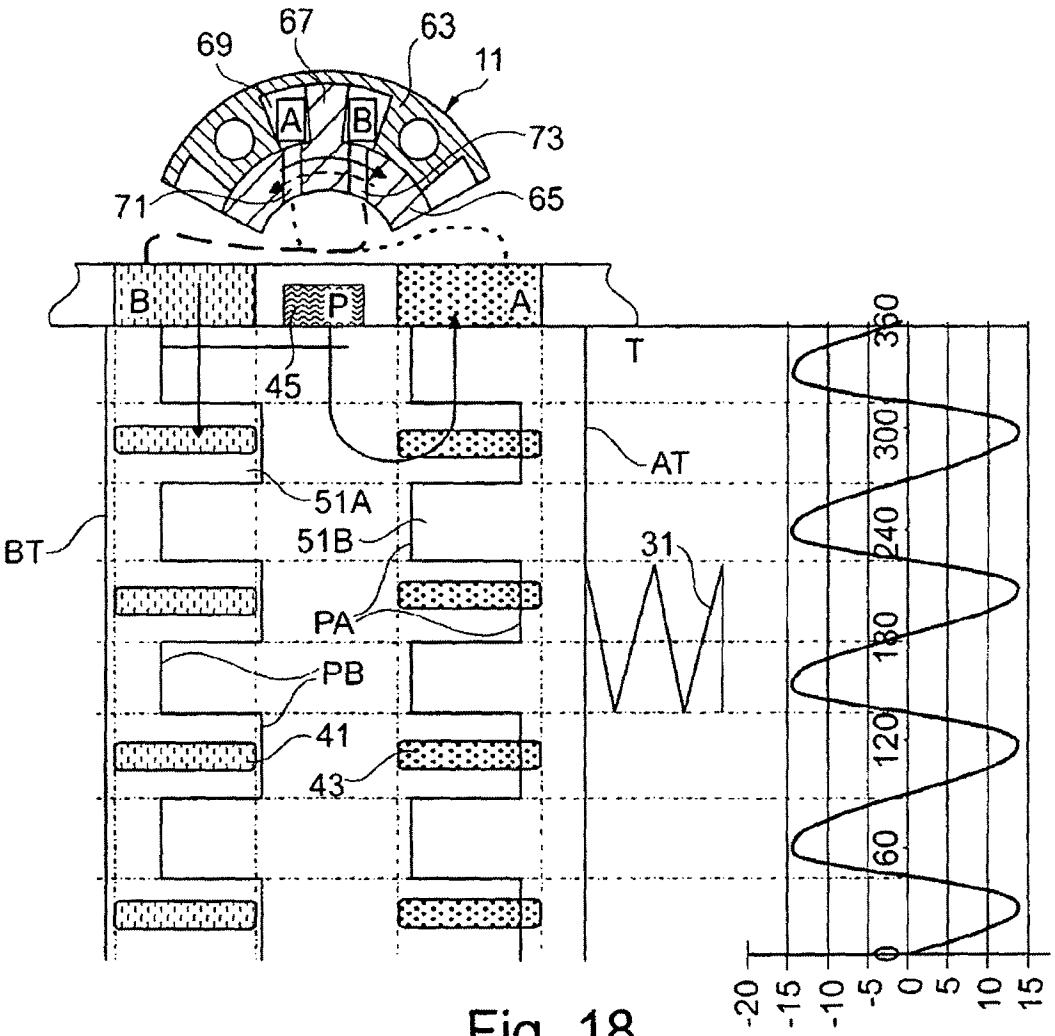

FIG. 18 shows the same axial switching position as FIG. 17, but here, the relative rotational position between the valve piston 27 and valve housing 29 has been changed, because now the camshaft 35 is in a rotational position in which an advance torque arises. Since it is still sought to realize a retardation adjustment (unchanged axial position of the valve piston 27), said advance torque must be suppressed with regard to its adjustment action. For this purpose, the first cover part 51A completely blocks the first orifices 41. Oil therefore cannot escape from the second chamber part B, and no adjustment takes place. The complete shut-off prevents a return swing. Via fully open second orifices 43, and therefore in an intensely dethrottled manner, the pump P pumps oil in an adjustment-neutral manner into the first chamber part A. Induction of air is prevented in this way.

Figure 19:
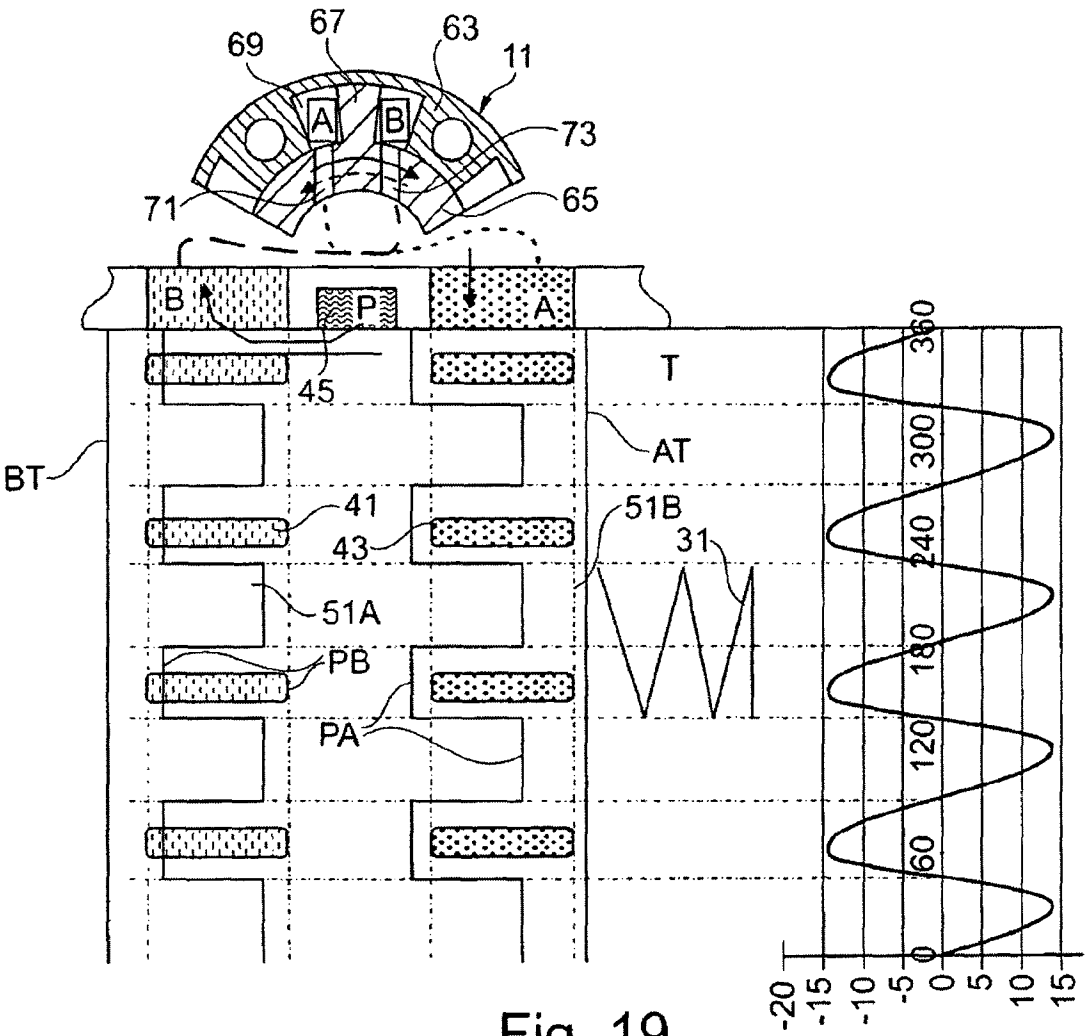
Figure 20:
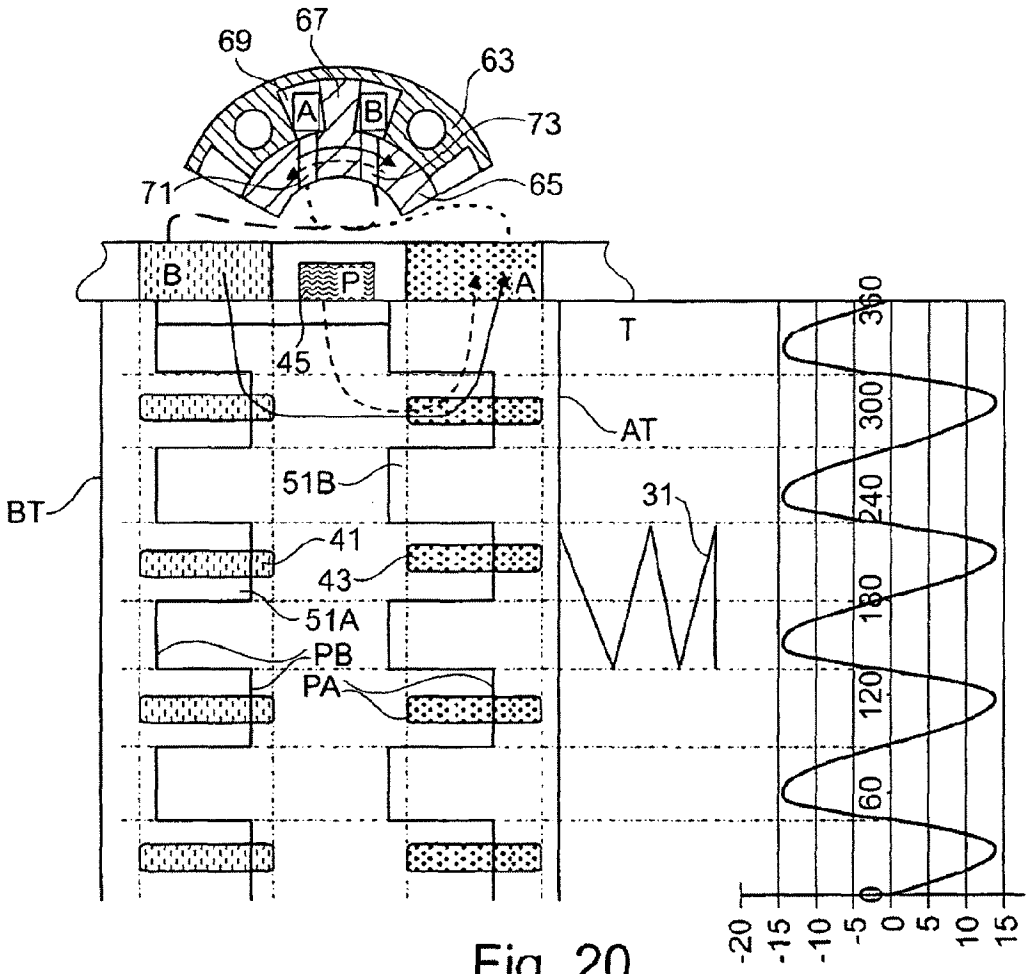

FIGS. 19 and 20 show positions corresponding to FIGS. 18 and 19, but for the opposite advance adjustment direction.

A particularly expedient sequence of switching positions can now be established by selecting axially successive switching positions as follows:

Switching position I: pump mode (OPA), retardation adjustment, FIGS. 5, 6

Switching position II: torque mode (CTA), advance adjustment, FIGS. 19, 20

Switching position III: blocked adjustment, FIGS. 9, 10

Switching position IV: torque mode (CTA), retardation adjustment, FIGS. 17, 18

Switching position V: pump mode (OPA), advance adjustment, FIGS. 7, 8

Figure 21:
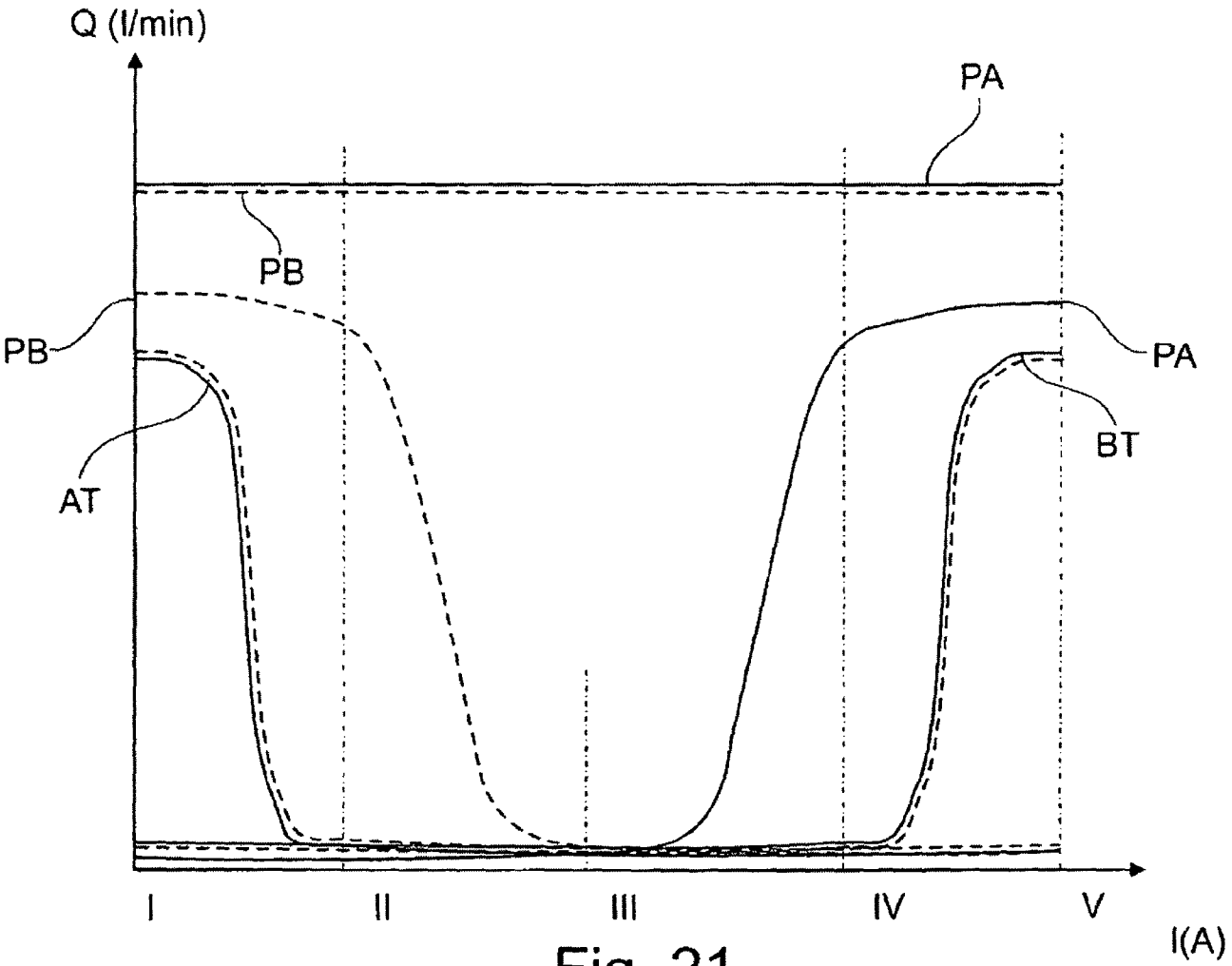
FIG. 21 is an illustration of the change in the flow rates at different control edges as a function of the switching position in the CTA method.

It is therefore possible, depending on the presence either of a dominating pressure of the pump P or of dominating camshaft torques for the camshaft adjustment, to set either a pump mode or a torque mode. FIG. 21 again illustrates, for said sequence of switching positions, how the throughflow of pressure medium at the respective control edges, that is to say inner and outer edges PA, PB, AT, BT varies as a function of the axial position of the valve piston 27 and of the valve housing 29, that is to say the switching positions I-V.

Figure 22:
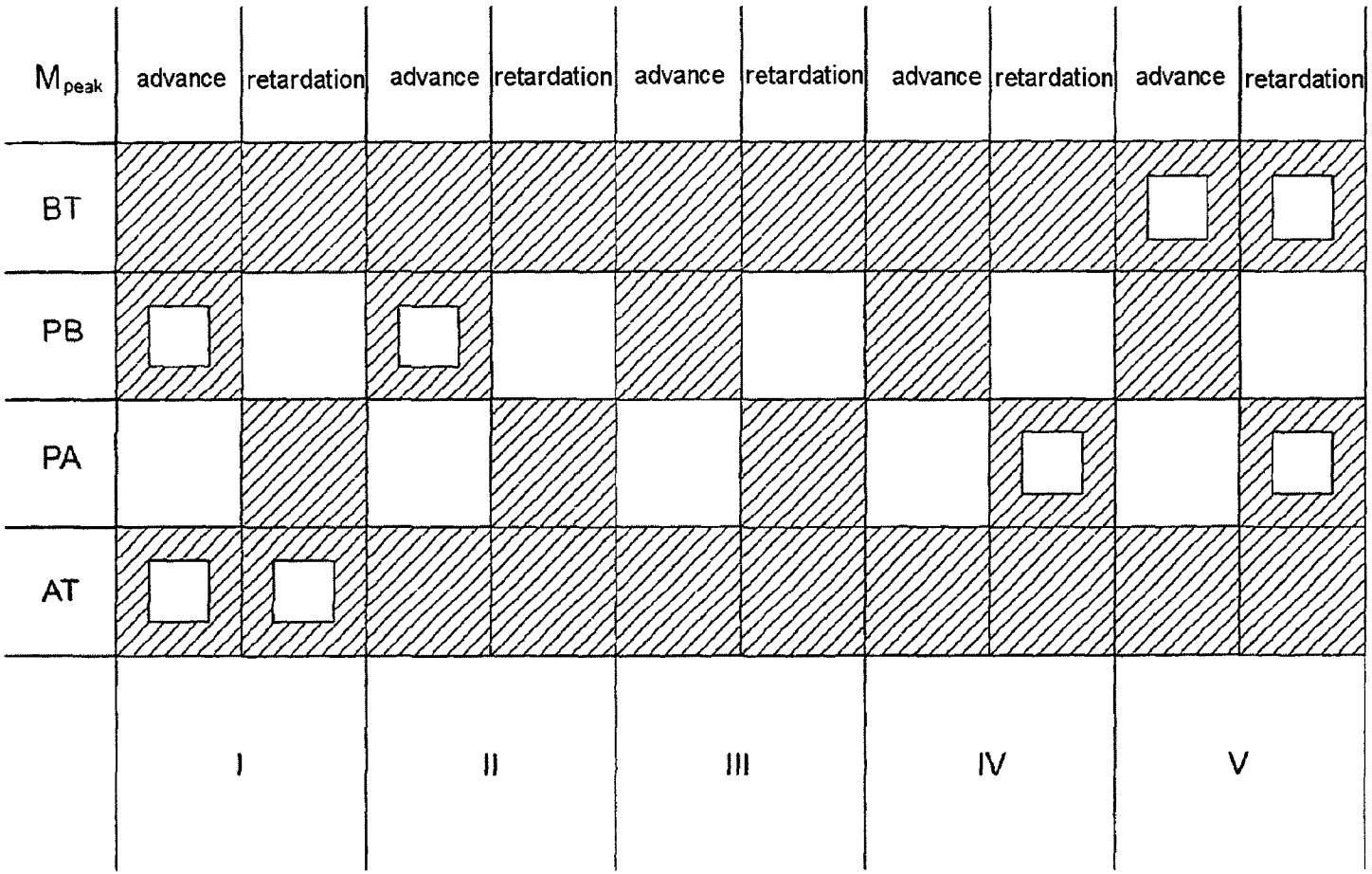
FIG. 22 is an illustration of the opening of the control edges as a function of the switching position in the CTA method.

FIG. 22 schematically shows, for the switching positions I-V, the degree of opening of the orifices 41, 43 as viewed from the respective inner edges PB, PA and outer edges BT, AT as a function of the switching positions I-V and the adjustment direction. Fully hatched fields correspond to a completely blocked orifice 41, 43, fully white fields correspond to a completely open orifice 41, 43, and partially hatched fields correspond to a partially blocked orifice 41, 43.

Figure 23:
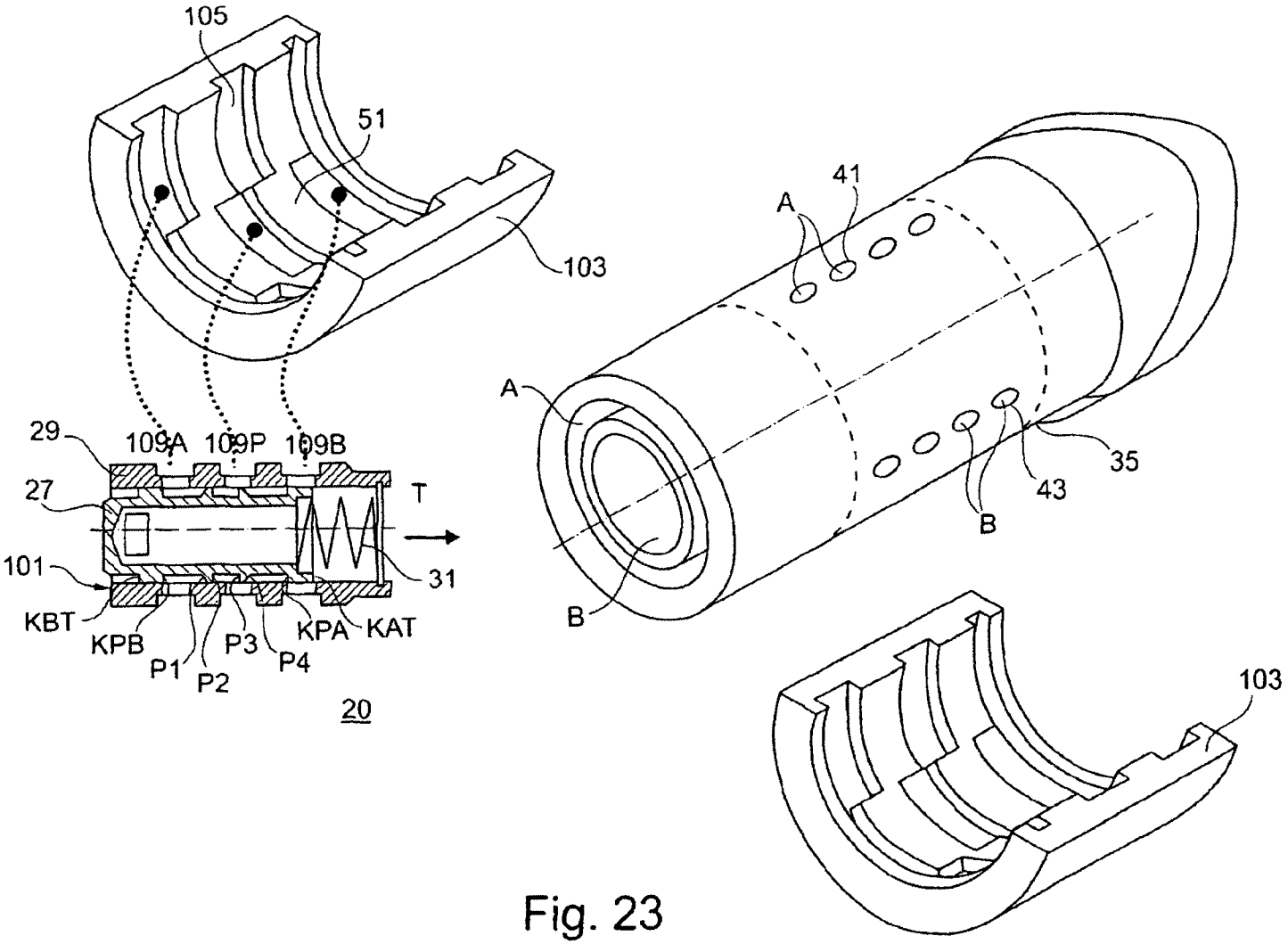
FIG. 23 shows a first variant of a control device with rotary transmitter, control valve and camshaft.

The illustrations and examples up to this point related to a variant suitable in particular as a so-called central valve embodiment, that is to say a control valve for controlling the supply and discharge of pressure medium to and from the chamber parts is arranged centrally in a camshaft. Below, a variant will be illustrated in which the control valve is arranged outside the camshaft and interacts with a rotary transmitter which, together with the control valve and the camshaft, controls a control device 20 for controlling the supply and discharge of pressure medium to and from the chamber parts. Here, the rotary transmitter performs the function of adaptation to the respective camshaft torques, whereas the control valve sets the setting for advancement, retardation or holding. This may be realized for example by means of the following embodiments:

FIG. 23 shows, in a cut-open state, a camshaft 35 and a rotary transmitter, designed as a bearing shell for the camshaft 35, in a perspective illustration. Adjacent thereto, a control valve 101 is illustrated in a longitudinal section. The camshaft 35 has concentric inner channels, wherein as indicated, one of said inner channels corresponds to the first chamber part A and one of said inner channels corresponds to the second chamber part B. First orifices 41, which correspond to the first chamber part A, and second orifices 43, which correspond to the second chamber part B, lead to said inner channels through the camshaft wall from the outside. In the installed state, the rotary transmitter 103 surrounds the camshaft 35 in the region of the dashed lines. Arranged on the inner side of the rotary transmitter 103 is an orifice cover 51 which forms a discontinuous bearing surface situated radially at the inside. Said bearing surface is made discontinuous by recesses 105. The orifice cover 51 could for example be milled out or formed for example by a soldered-on insert. The first orifices 41 and second orifices 43 are now covered or opened up by the orifice cover 51 as a function of an angle of rotation of the rotatable camshaft 35 and of the non-rotating rotary transmitter 103. Since the rotational position of the camshaft 35 is synchronous with the camshaft torques, it is possible in this way for an inflow or outflow of pressure medium through the first orifices 41 and second orifices 43, and therefore the inflow and outflow of pressure medium into and out of the chamber parts A, B, to be set as a function of the acting camshaft torque.

The illustration of the control valve 101 in longitudinal section illustrates the assignment to a pump orifice 109P and to chamber part orifices 109A, 109B in the valve housing 29. Said orifices are opened up or closed off by the axially displaceable valve piston 27 arranged in the valve housing 29, specifically by means of the control edges KAT, KPA, KBT, KPB at the chamber part orifices 109A, 109B and by means of the control edges P1, P2, P3, P4 at the pump orifice 109P. Said control edges are formed by projections or lugs on a cylindrical surface of the valve piston 27, wherein in each case one projection or lug has a pair of control edges. In relation to valve designs in the prior art by means of which conventional hydraulic control of a camshaft adjustment is realized, the present design has in particular the special feature of the additional control edges P1, P2, P3, P4. In interaction with the first and second orifices 41, 43 in the camshaft 35 and the orifice cover 51 in the rotary transmitter 103, it is now possible to set different switching positions as a function of the engine operating state, in particular of the engine oil pressure and of the magnitude of the camshaft torques. This will be explained in more detail on the basis of the following Figures.

FIGS. 24-28 show, for the variant of the rotary transmitter 103 shown in FIG. 23, a schematic illustration of the control of pressure medium as a function of the camshaft torque by means of rotary transmitter, camshaft and control valve. Again, in the upper region, the control valve 101 is illustrated in a longitudinal section. The axial position of the valve piston 27 of the control valve 101 is determined by a magnet 21. Here, a percentage indicates the degree of energization of the electromagnet 21, and therefore the degree of axial displacement of the valve piston 27. Below, 5 switching positions are illustrated, at 100%, 75%, 50%, 25% and 0% energization. Other values for the energization may self-evidently also be possible here. Below the control valve 101, on the left, the stator and rotor of a camshaft adjuster 11 with chamber parts A, B are depicted schematically, as in earlier Figures. To the right thereof there is illustrated a longitudinal section through a part of the camshaft 35 and of the rotary transmitter 103 arranged around said camshaft, which longitudinal section leads through the first and second orifices 41, 43. Below this, said region is illustrated schematically in a circumferentially developed view, illustrating the overlap of the orifice cover 51 with the first and second orifices 41, 43. In a synchronous illustration to the right thereof there is depicted the profile of the camshaft torques and the alignment thereof in the advance or retardation directions.

Figure 24:
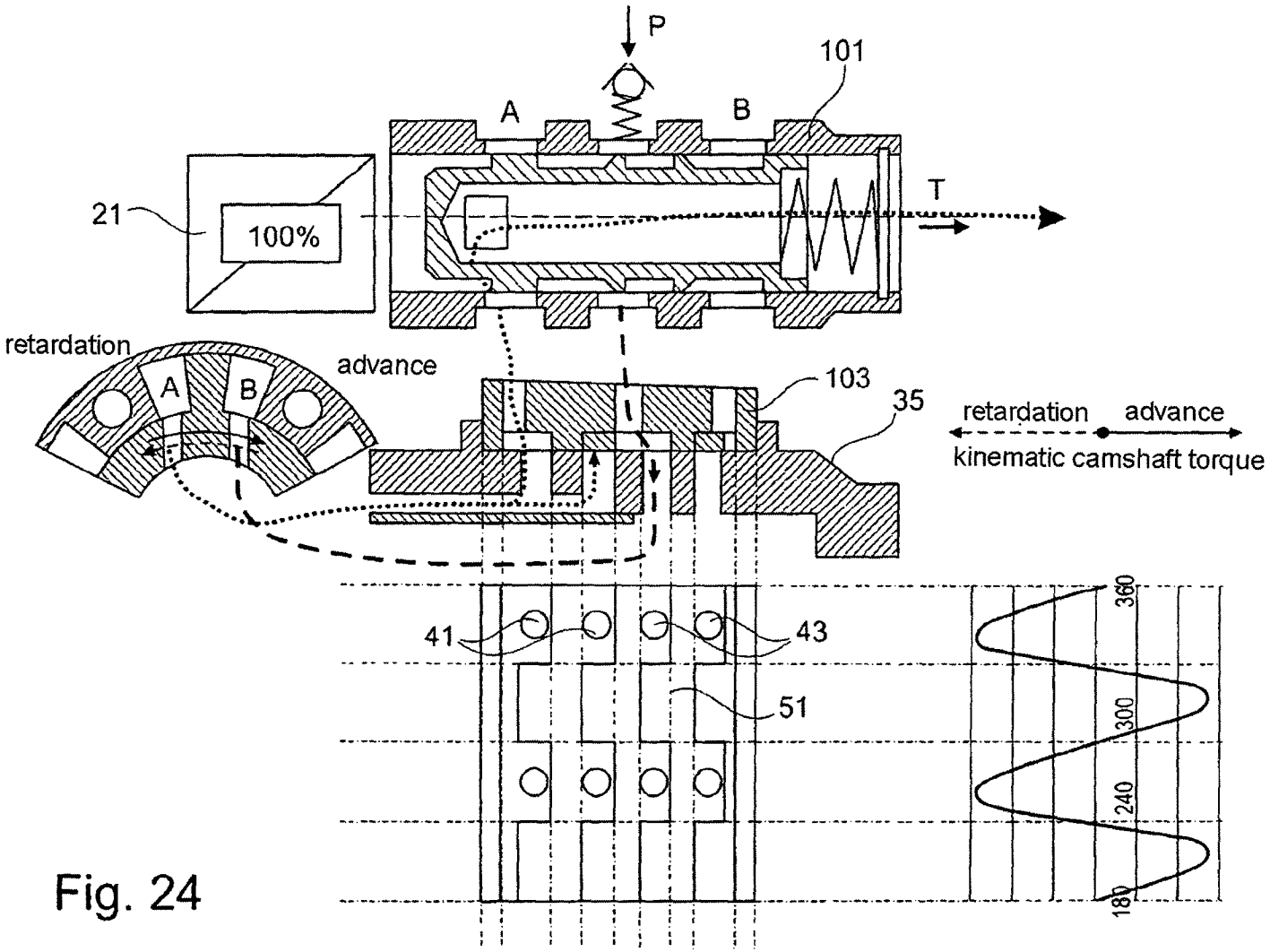
FIGS. 24-28 are schematic illustrations of the control of pressure medium as a function of the camshaft torque, by means of rotary transmitter, camshaft and control valve, in the first variant.
Figure 25:
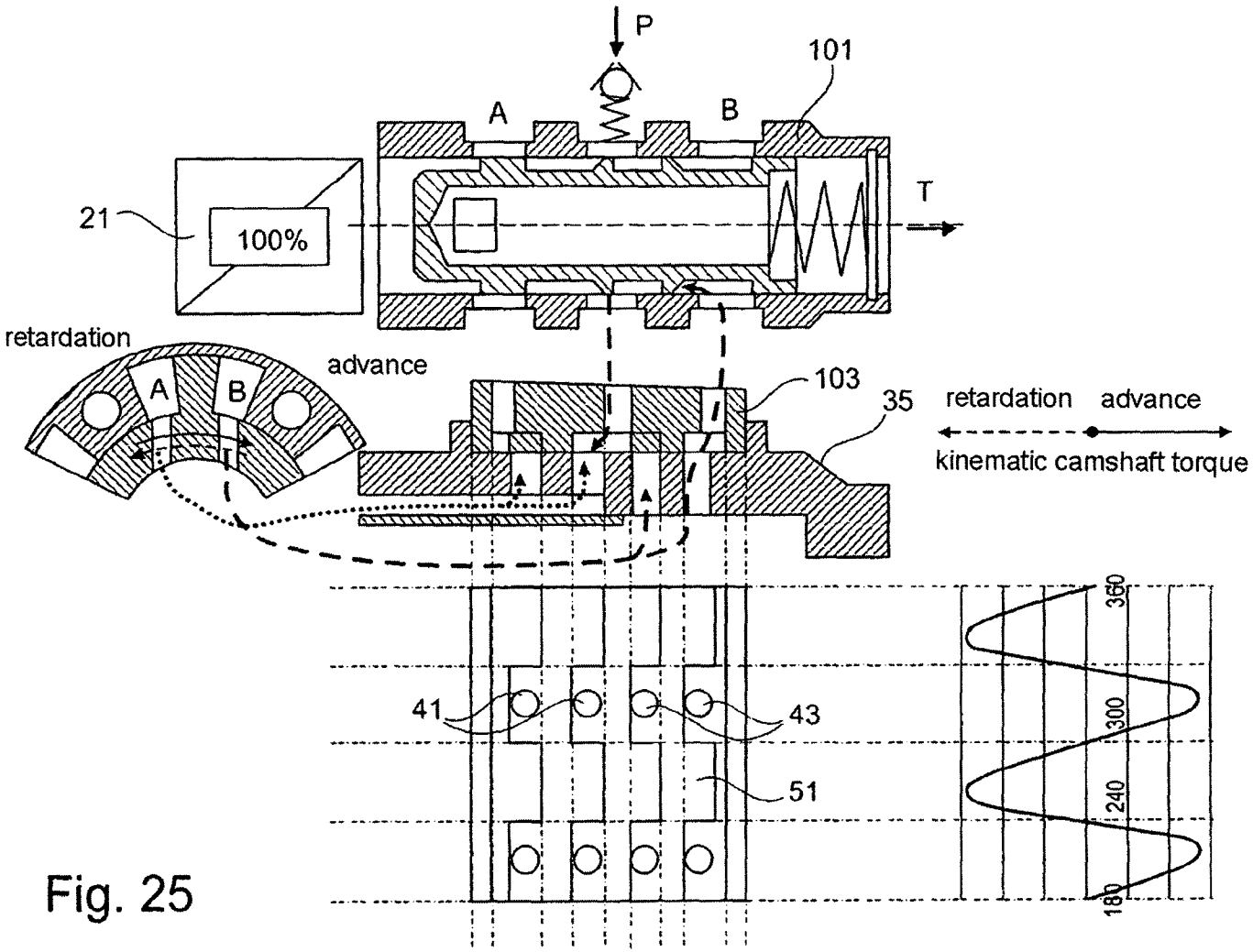

FIG. 24 now shows a first switching position in the case of 100% energization of the electromagnet 21 and therefore in a first axial position of the valve piston 27. Said switching position corresponds to an adjustment in the retardation direction, wherein corresponding to the relative rotational position of the rotary transmitter 103 and of the camshaft 35, an angular position for a camshaft torque in the retardation direction is set. The dashed and dotted lines schematically show the flow directions of the pressure medium. Pressure medium passes via the pump orifice 109P in the valve housing 29 via the second orifices 43 into the second chamber part B. At the same time, pressure medium is conducted out of the first chamber part A via the first orifices 41 and the chamber part orifice 109A to the tank. Here, the cross sections of the orifices opened up by means of the control edges P1, P2 and KAT are large, that is to say intense dethrottling is attained. This firstly prevents a damaging induction of air, and secondly permits a fast adjustment. FIG. 25 shows an image corresponding to FIG. 24, but the rotational position of the camshaft 35 has now changed such that an advance torque arises. In contrast to the retardation torque, which in FIG. 24 assists the retardation adjustment direction, the advance torque leads to a force directed counter to the desired adjustment, and therefore to a retardation. This is suppressed by virtue of the outlet from the second chamber part B now being closed off by means of the control edge P4, and therefore no adjustment being possible, because no pressure medium can be displaced out of the chamber part B.

The switching position of FIGS. 24 and 25 thus corresponds to a retardation adjustment, specifically in the pump mode, because predominantly the pressure of the pressure medium provided by a pump P is utilized for adjustment. However, should an operating state arise in which the pressure is low and is not sufficient for a fast adjustment, the valve piston 27 can be moved into its next axial position in which the torque mode for a retardation is set. This will be explained on the basis of FIGS. 26 and 27.

Figure 26:
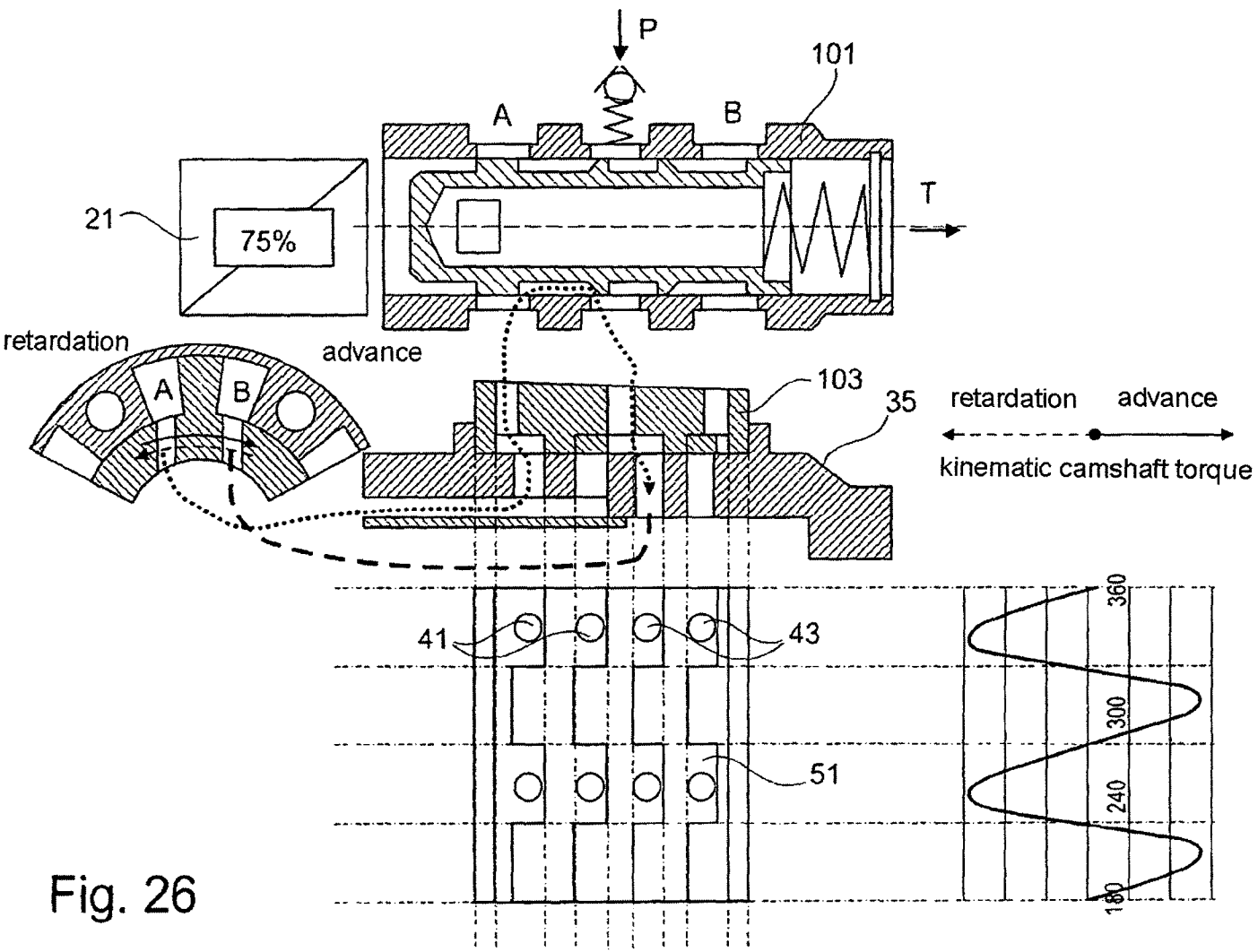
Figure 27:
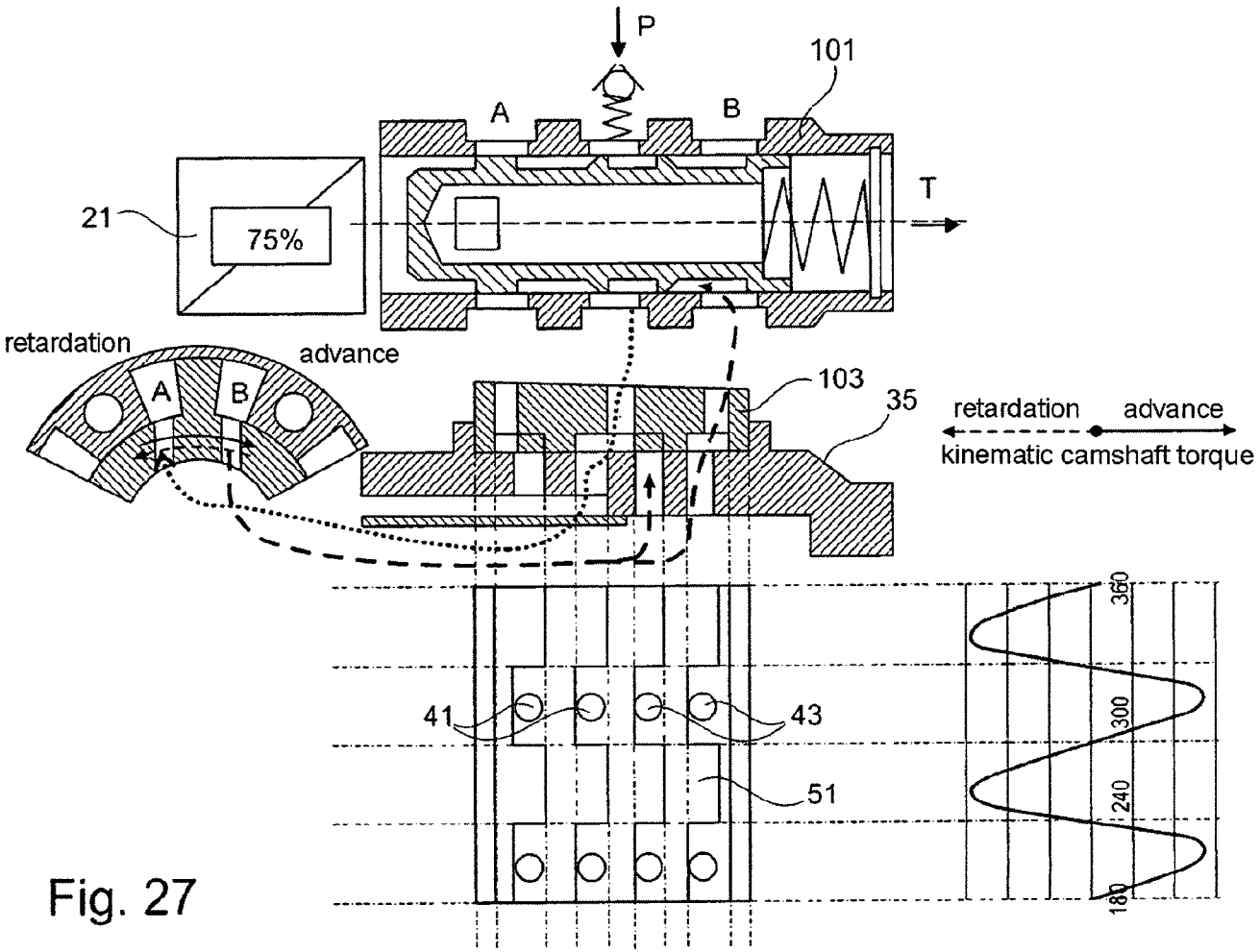

FIGS. 26 and 27 show an image corresponding to FIGS. 24 and 25, wherein now the electromagnet is only 75% energized and the valve piston 27 therefore assumes a new axial switching position in the direction of the magnet 21. Said switching position likewise effects a retardation. Now, however, upon the occurrence of a retardation torque, the chamber parts A, B are connected, such that pressure is built up in the first chamber part A by the retardation torque, as a result of which pressure medium is displaced from the first chamber part A into the second chamber part B. This leads to the desired adjustment. Upon the occurrence of an advance torque, however, the outlet from the second chamber part B is again blocked, such that no adjustment can take place.

Figure 28:
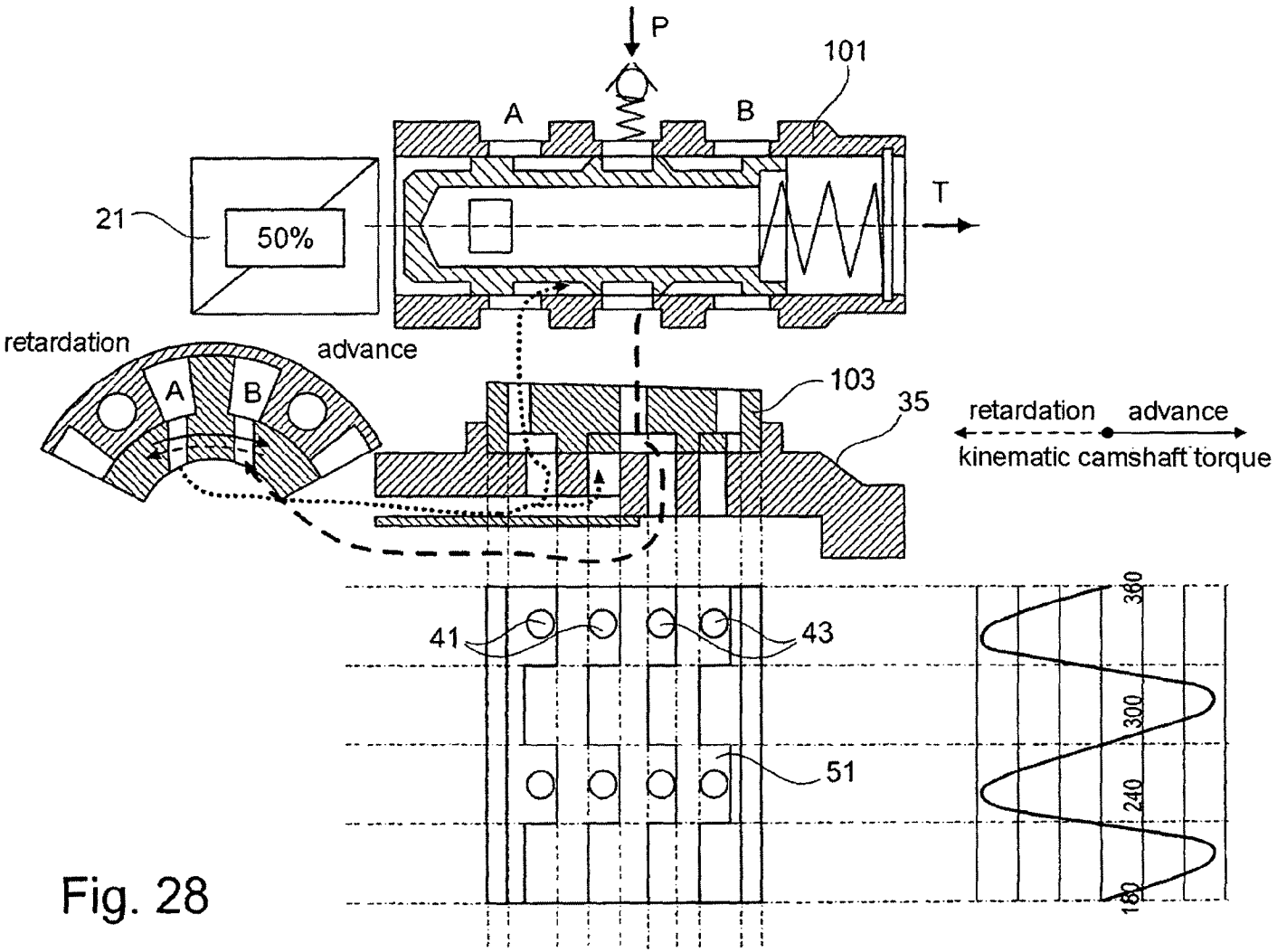

FIG. 28 shows a switching position in the case of 50% energization of the electromagnet 21. In said switching position, the angular position of the camshaft 35 is held, that is to say no adjustment takes place. This is achieved in that, upon the occurrence of a retardation torque, an outlet from the first chamber part A is blocked, as illustrated in FIG. 28. Upon the occurrence of an advance torque, not illustrated, the first and second orifices 41, 43 would again come to rest in a position in which an outlet out of the second chamber part B is blocked, such that in this case, too, no adjustment is possible.

Corresponding to FIGS. 24-27, in the case of a switching position of 25% energization, a torque mode can be set for an advance, and in the case of a switching position of 0%, a pump mode can be set for an advance, with correspondingly interchanged opening-up or blocking of the orifices. Through simple selection of the axial position of the valve piston 27, it is thus possible for the first time to select a pump mode or a torque mode, that is to say an OPA method or a CTA method, for the adjustment as a function of the operating state of the internal combustion engine. Through said adaptability, particularly fast adjustment is thus achieved overall. In addition to this there is the intense dethrottling in each case, which likewise ensures a fast adjustment and additionally prevents an induction of air.

Figures 29, 29A, 29B, 29C:
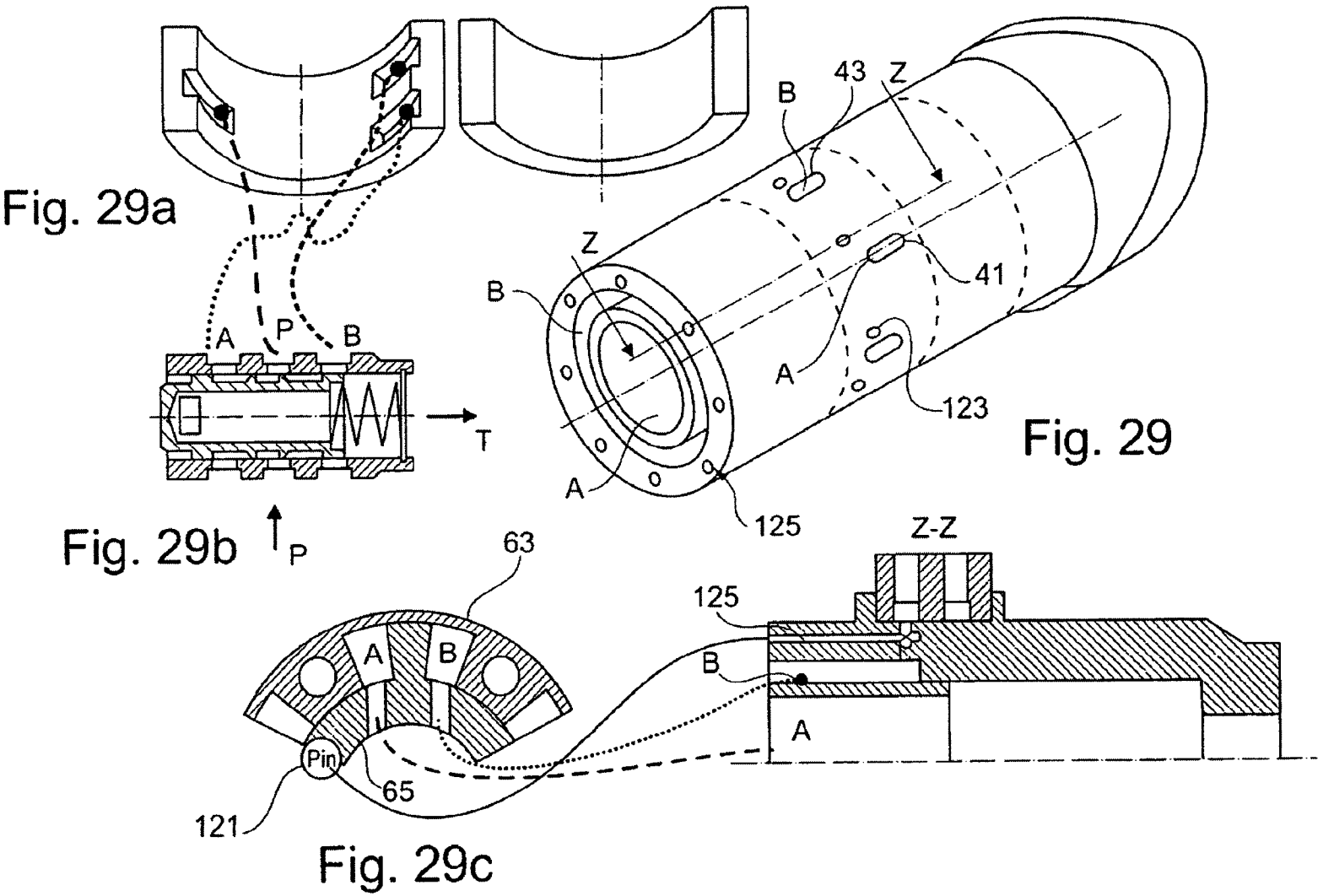
FIGS. 29-29*c* show a second variant of the control device with rotary transmitter, control valve and camshaft, with a locking mechanism.

FIG. 29 illustrates a second variant which corresponds to the illustration of FIG. 23, wherein however the orifice cover 51 is now delimited by three groove-like recesses 105. Furthermore, there is provided in the rotor 65 of the camshaft adjuster 11 a locking mechanism 121 which, in the form of a locking pin, can lock (in a manner not illustrated in any more detail) into a locking slot of the stator 63 under the pressure of a spring. In this way, an adjustment is blocked. Unlocking is effected by a hydraulic pressure counter to the spring, wherein pressure medium is supplied to the locking mechanism 121. Said pressure medium is now supplied via a separate locking feed line 125 which corresponds to locking orifices 123 in the camshaft 35. The locking orifices 123 are arranged at the same level as the second orifices 43 in the axial direction but spaced apart from the second orifices 43 in the circumferential direction. Furthermore, two locking orifices 123 are arranged in the circumferential direction between in each case two second orifices 43. The first orifices 41 and the second orifices 43 are formed in this variant as axially extending slots. The function will be explained in the following Figures.

FIGS. 30-35 show the different switching positions of the valve piston 27 and the relative alignment of the first and second orifices 41, 43 and of the locking orifices 123 with respect to the orifice cover 51. The illustration corresponds to the illustration of FIGS. 24-28, wherein however the described second variant of the first and second orifices 41, 43 and of the orifice cover 51 and also of the additional locking mechanism 121 is shown. In this embodiment, the second orifices 43 now lie on the left, and the first orifices 41 lie on the right.

Figure 30:
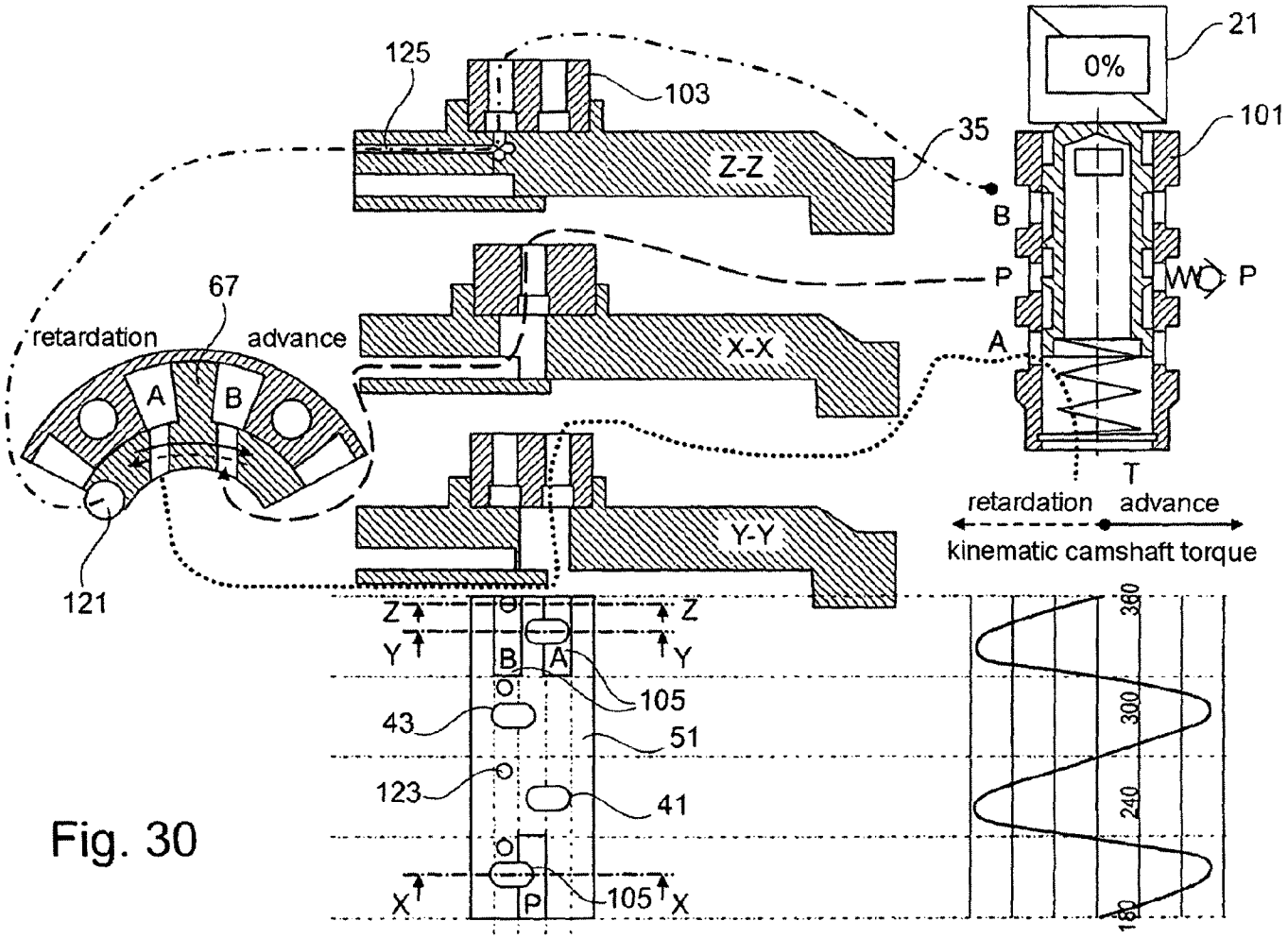
FIGS. 30-35 are schematic illustrations of the control of pressure medium as a function of the camshaft torque by means of rotary transmitter, camshaft and control valve, in the second variant.

FIG. 30 shows a switching state with 0% energization of the magnet 21, such that the valve piston 27 is set in its axial basic position. This is the situation for example when the internal combustion is shut down and the chamber parts A, B are not pressurized. The vane 67 of the rotor 65 should be abutting against the stator at the left in the Figure, that is to say in a position of maximum retardation. For simplicity and to make it possible to illustrate the chamber parts A, B, however, the same position of the vane 67 is always depicted in each of the Figures regardless of the adjustment state. The switching position corresponds to a retardation, wherein FIG. 30 illustrates the situation of the occurrence of a retardation torque. In said rotational position, one of the second orifices 43 corresponds to one of the recesses 105 which is supplied with pressure medium by the pump P via the pump orifice 109P of the valve housing 29. The second chamber part B is thereby also supplied with pressure medium. Pressure medium can flow out of the first chamber part A via one of the first orifices 41 which corresponds to the recess 105 which is connected to the chamber part A of the valve housing. The pressure medium is then conducted to the tank via the chamber part orifice A which is opened up by the valve piston 27 in this axial position. Despite these settings, an adjustment does not take place in this case because the vane 67 is already against the retardation stop.

The locking mechanism 121 is locked in said basic position such that, in the event of an engine start, the camshaft torques which then arise and the lack of pressure in the chamber parts A, B do not result in disturbing rattling on account of the vane 67 abutting alternately at the left and at the right against the stator 63.

One of the locking orifices 123 corresponds to one of the recesses 105 which corresponds to the chamber part orifice 109B of the valve housing 29. Owing to the position of the valve piston 27, however, said chamber part orifice 109B is not supplied with pressure, or is shut off. It is therefore also the case that a pressure increase which arises after an engine start, for example as a result of an air column pushed in by the oil, cannot pass to the locking mechanism 121. Undesired unlocking is therefore not possible.

Figure 31:
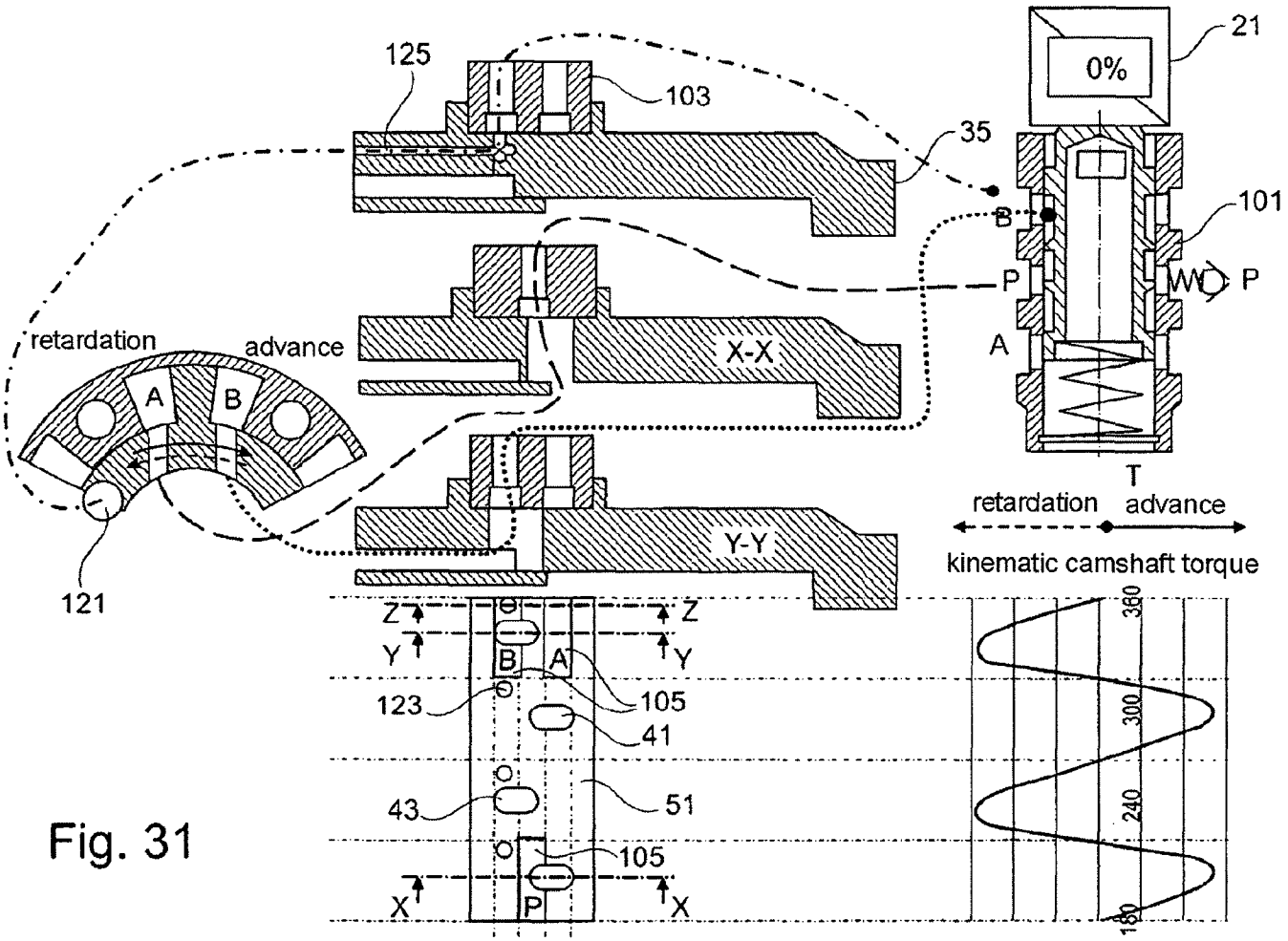

FIG. 31 shows an image corresponding to FIG. 30, but the rotational position of the camshaft 35 has changed and now an advance torque arises. During operation with charged chamber parts A, B, said advance torque would now be unable to effect an adjustment in the advance direction, because the outlet from chamber part B is blocked. A return swing therefore does not occur. In the unpressurized, locked basic position, the adjustment position is likewise maintained owing to the locking. The locking is also not released, because the locking mechanism 121 remains unpressurized.

Figure 32:
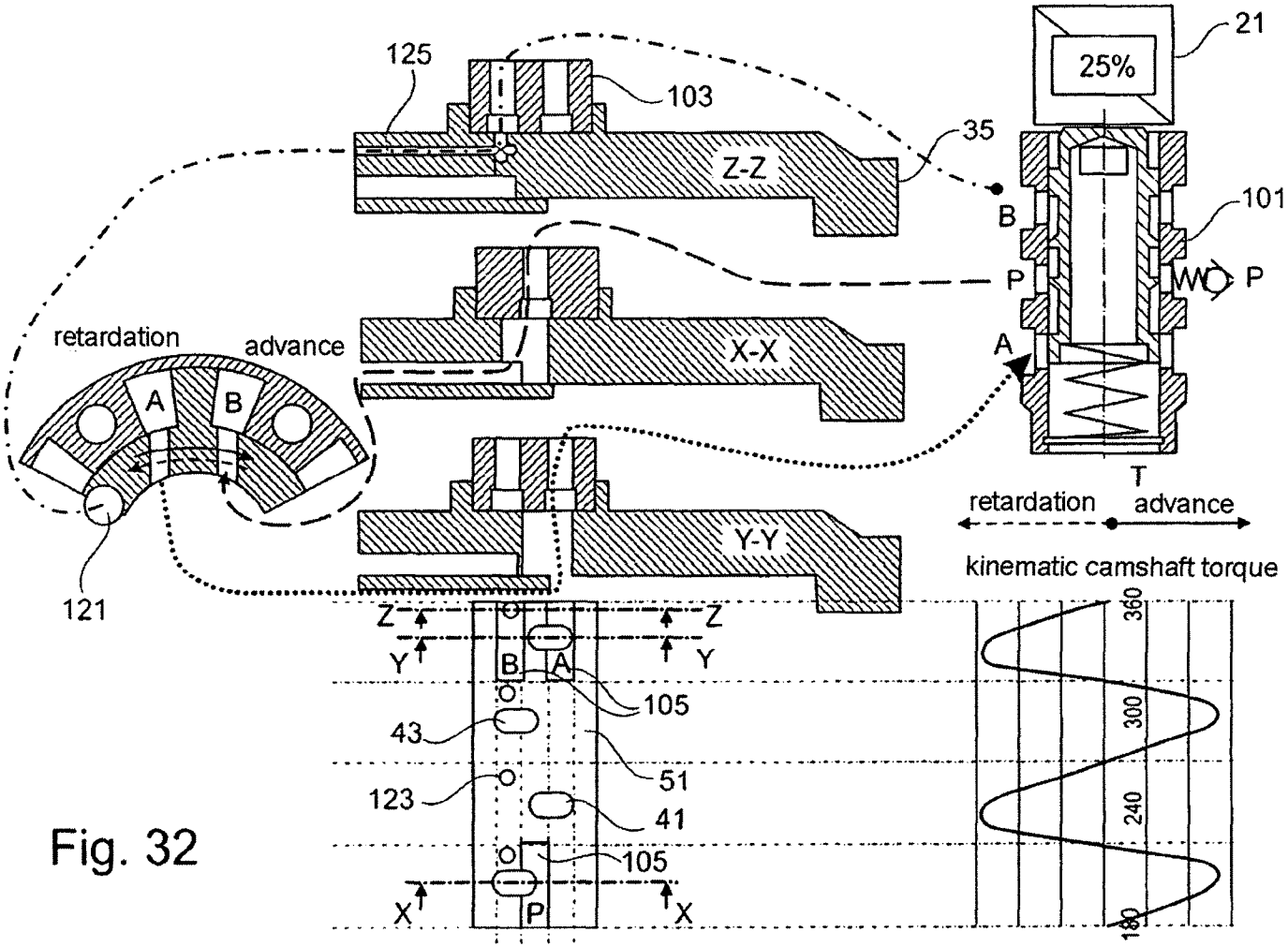

FIG. 32 now shows a switching position in which the valve piston 27 has moved axially further corresponding to an energization of the magnet 21 with 25% of the maximum current. The Figure shows the situation of the occurrence of a retardation torque. Said switching position corresponds to the torque mode, whereas the switching position discussed with regard to FIGS. 30 and 31 corresponds to the pump mode. The valve piston 27 now opens up a connection of the chamber part orifice 109A to the pump orifice 109P. The pump orifice 109P corresponds to the second chamber part B, whereas the chamber part orifice 109A corresponds to the first chamber part A. A connection of the chamber parts A, B, or a short circuit, so to speak, is produced.

Figure 33:
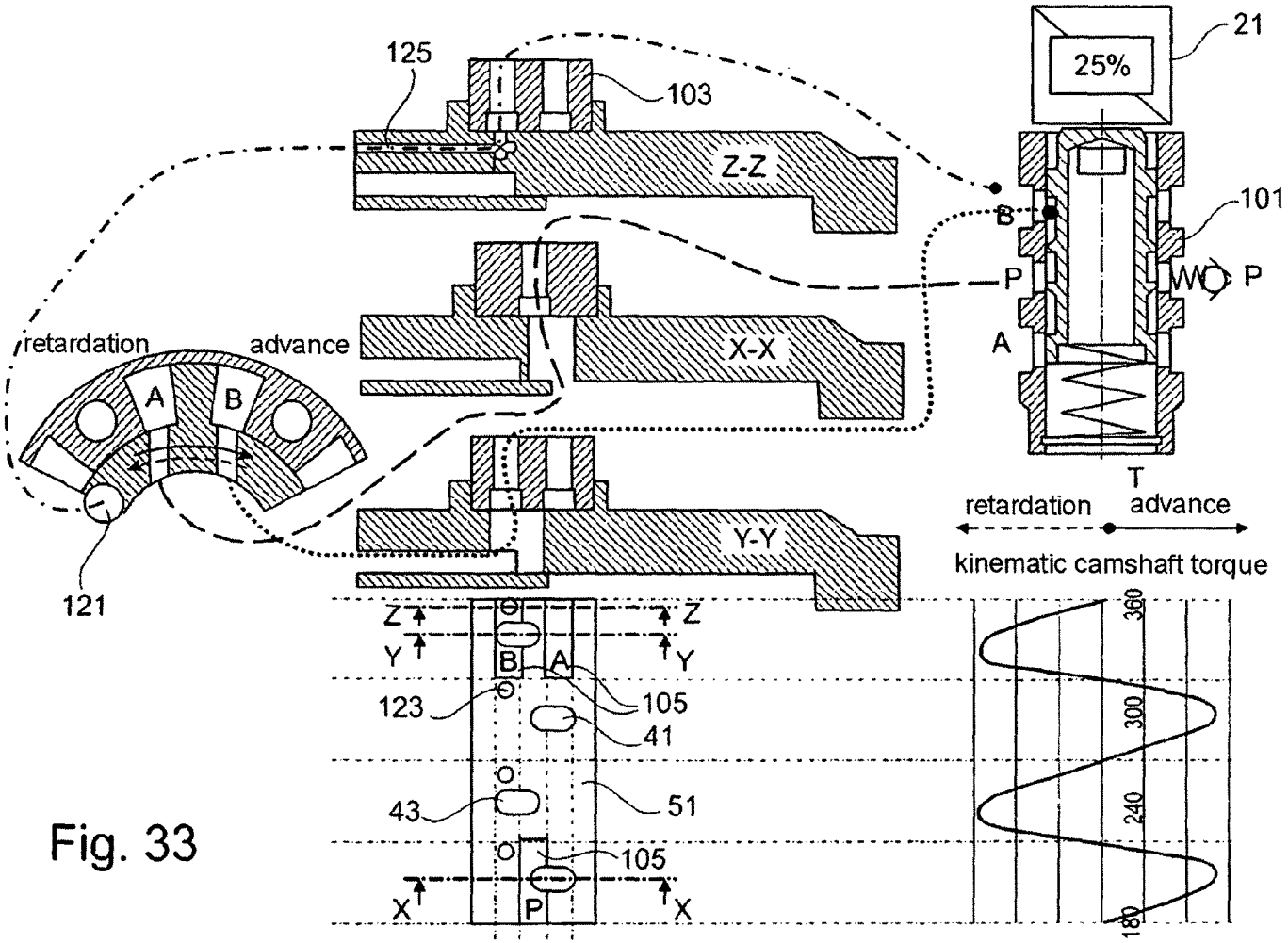

During operation, with charged chamber parts A, B, the following applies: Upon the occurrence of a retardation torque, that is to say a torque in the desired adjustment direction, the vane 67 exerts pressure on the first chamber part A, and is displaced in the retardation direction by a displacement of pressure medium from the first chamber part A into the second chamber part B. FIG. 33 shows the rotational position upon the occurrence of an advance torque. The second chamber part B is blocked by the position of the valve piston 27, such that no pressure medium can be discharged. The pressure exerted on the second chamber part B by the advance torque therefore does not lead to an adjustment.

Shortly after starting of the engine, when the chamber parts A, B are not yet charged, the locking mechanism 121 is still locked, and also continues to be held in an unpressurized state by blocking as in the 0% switching position, that is to say said locking mechanism remains locked, and an adjustment remains blocked.

Figure 34:
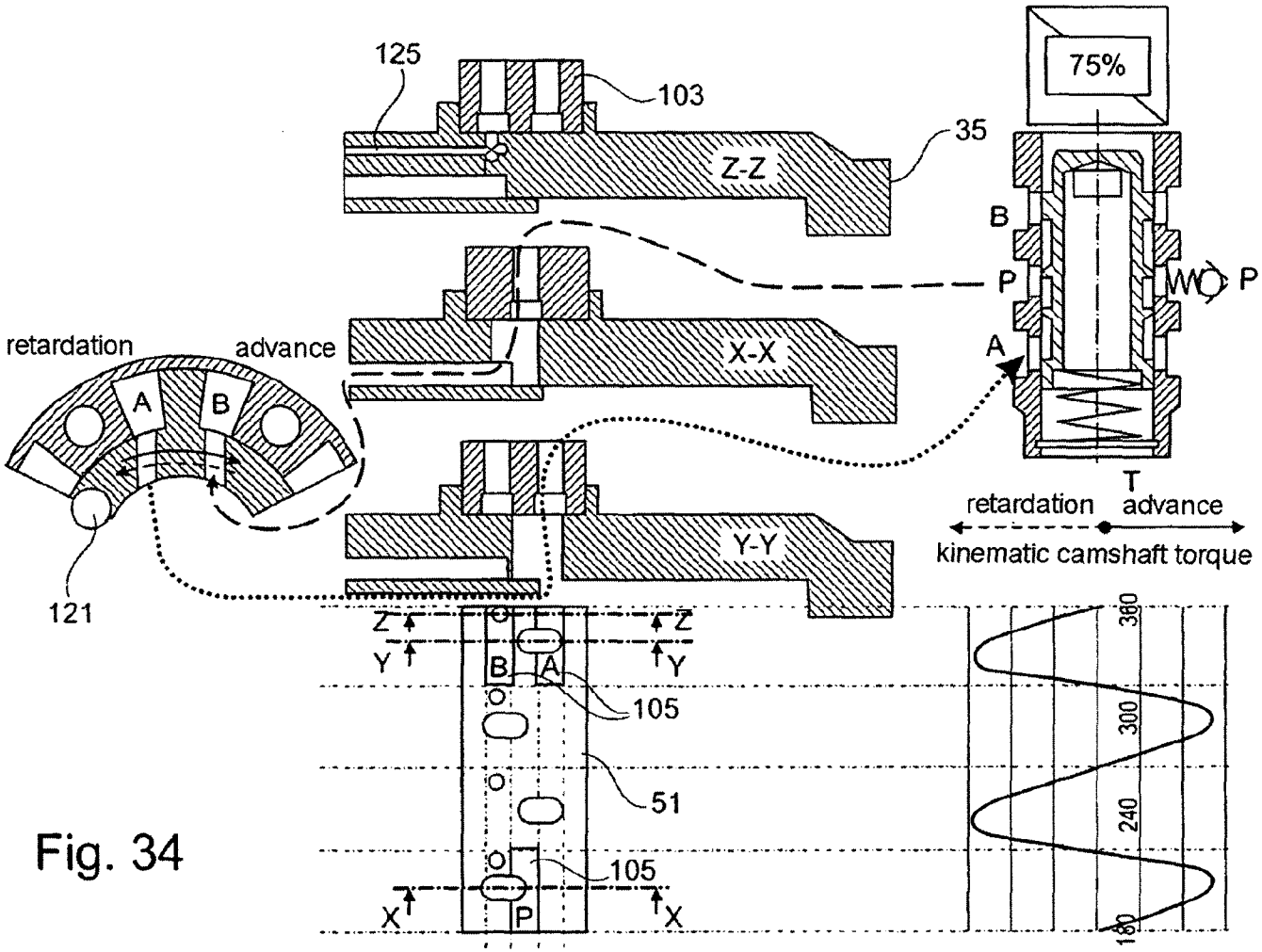
Figure 35:
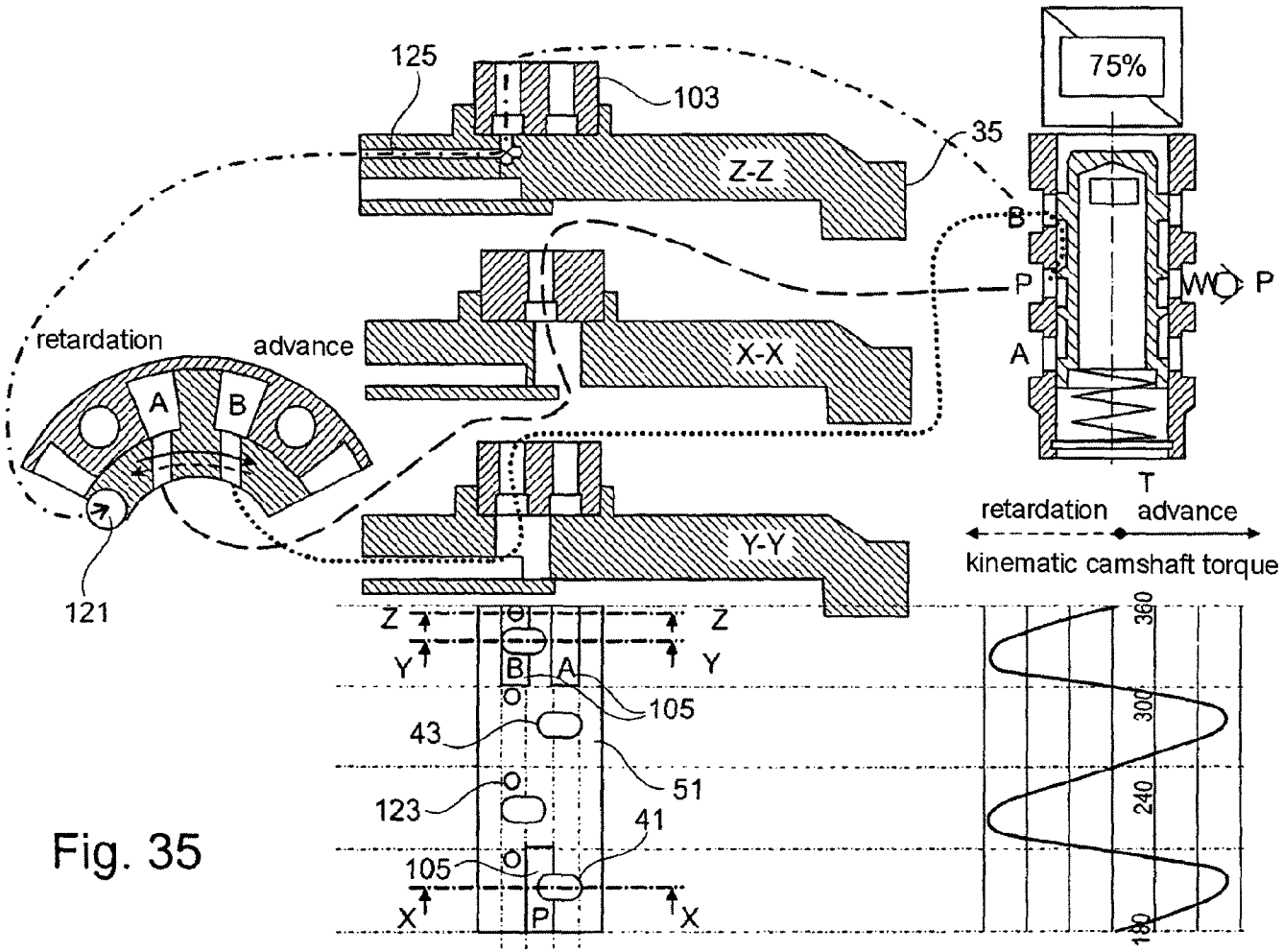

FIG. 34 now shows an image corresponding to FIGS. 30-33, wherein now an axial switching position of the valve piston 27 at 75% is set. This is again a setting of the torque mode, but in this case for an advance adjustment. The same mechanism as that for the adjustment utilizing the camshaft torques, as described with regard to FIGS. 32 and 33, applies here with corresponding interchangement, with the exception of the fact that now the locking mechanism 121 receives pressure because the chamber part orifice 109B of the valve housing 29 is now opened up by the valve piston 27, and therefore pressure medium passes to the locking mechanism 121. As a result, said locking mechanism is pushed back counter to its spring and is unlocked. An adjustment is now possible if an advance torque arises, as illustrated in FIG. 35. The release of the locking mechanism 121 however takes place after an engine start only when a pressure prevails which is adequate to prevent undesired unlocking.

Figure 36:
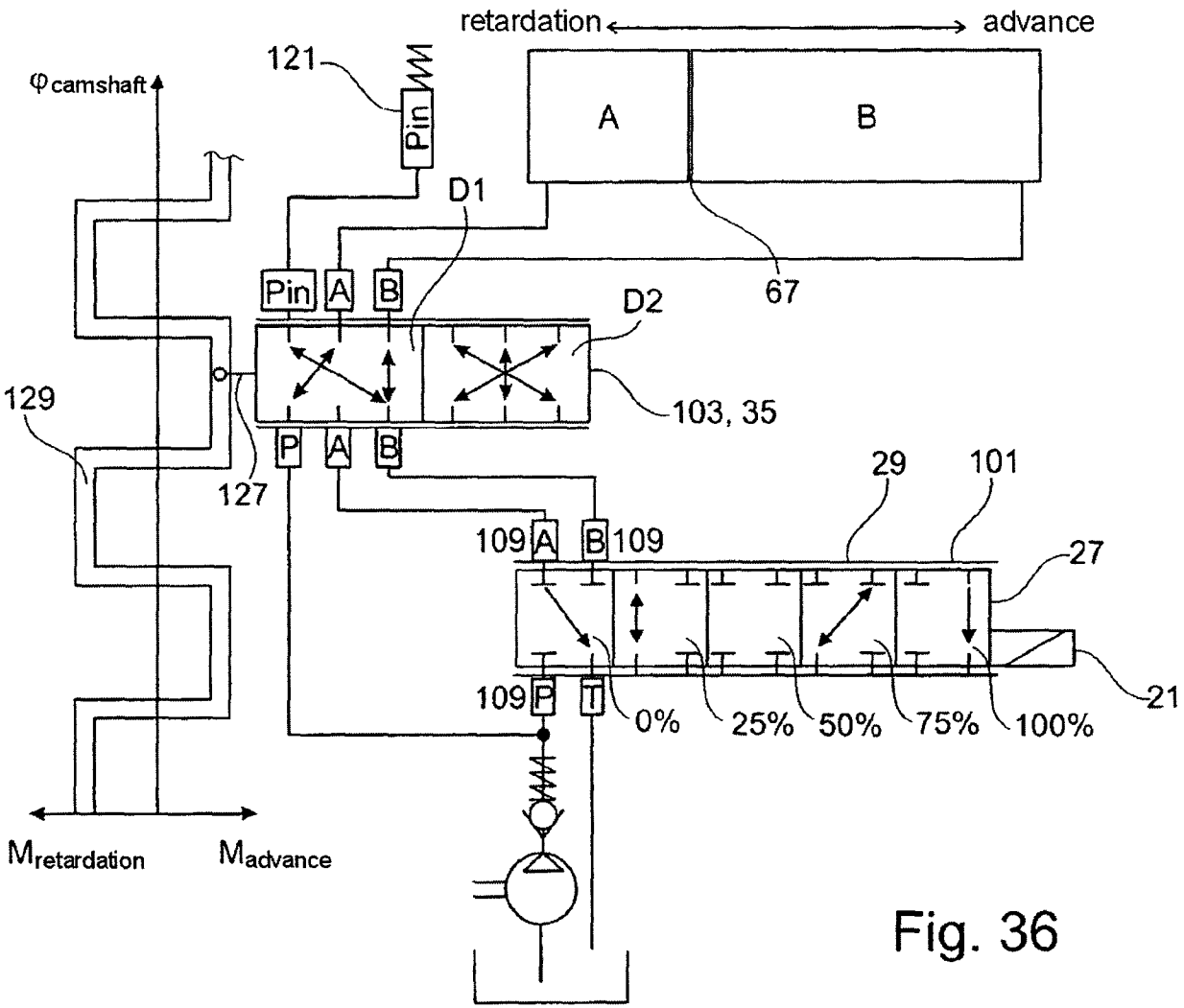
FIG. 36 shows a schematic hydraulic circuit diagram for the five switching positions.

Not illustrated in any more detail is the axial switching position at 100% energization, which corresponds to the pump mode for an advance adjustment, and which functions in a similar way to the retardation adjustment of the pump mode as described on the basis of FIGS. 30 and 31. The five axial switching positions and the camshaft-torque-dependent rotational position can be summarized in a hydraulic circuit diagram shown in FIG. 36. Schematically shown is the control valve 101, wherein the five switching positions of the valve piston 27 which correspond to 0%, 25%, 50%, 75% and 100% energization of the magnet 21 are illustrated in five squares adjacent to one another. The chamber part orifices 109A, 109B, pump orifice 109P and outlet to the tank T of the valve housing 29 are fixed and can be occupied by the various connections, illustrated by arrows, or closures, illustrated as "T", by virtue of the corresponding square of the desired switching position being moved to the ports. The relative rotational position of the camshaft 35 and of the rotary transmitter 103 are likewise schematically illustrated by an axial position displacement, wherein the coupling to the camshaft torques is depicted by the guidance of a guide pin 127 in a rectangular-waveform guide groove 129, and the guide pin 127 activates the first or second rotational position D1, D2 as a function of the occurrence of an advance torque or retardation torque. The guide pin 127 and guide groove 129 are thus fictitious and serve merely for illustration. The two rotational positions D1, D2 are illustrated in two mutually adjacent rectangles, and, as stated, are transformed into an axial displacement in order to be able to better depict the switching logic. Here, too, arrows show the ports connected to one another in each case. The image thus shows specifically an occurrence of an advance torque (guide pin 127 in a right-hand groove part of the guide groove 129) and a retardation adjustment in the pump mode. An outflow from the second chamber part B is blocked, that is to say no adjustment takes place. Upon the occurrence of a retardation torque, the rotational position D2 would be activated, as a result of which pressure is passed to the second chamber part B, and at the same time the first chamber part A is open to the tank. A retardation adjustment then takes place.

LIST OF REFERENCE SYMBOLS

1 Internal combustion engine
2 Crankshaft
3 Piston
4 Cylinder
5 Traction mechanism drive
6 Intake camshaft
7 Exhaust camshaft
8 Cam
9 Intake gas exchange valve
10 Exhaust gas exchange valve
11 Camshaft adjuster
12 Cylinder valve
20 Control device
21 Magnet
23 Magnet piston
25 Rotation prevention means
27 Valve piston
29 Valve housing
31 Restoring spring
33 Axial bearing arrangement
35 Camshaft
41 First orifices
43 Second orifices
45 Third orifices
51 Orifice cover
51A First cover part
51B Second cover part
52 Crown serrations
53 Valve piston surface
63 Stator
65 Rotor
67 Vane
69 Pressure chamber
71 First oil channel
73 Second oil channel
101 Control valve
103 Rotary transmitter
105 Recesses
109P Pump orifice
109A Chamber part orifice to chamber part A
109B Chamber part orifice to chamber part B
121 Locking mechanism
123 Locking orifice
125 Locking feed line
127 Guide pin
129 Guide groove
A First chamber part
B Second chamber part
P Pressure medium pump
T Tank
PA Inner edge of the second cover part 51B
PB Inner edge of the first cover part 51A
AT Outer edge of the second cover part 51B
BT Outer edge of the first cover part 51A
P1, P2, P3, P4 Pump control edges
KAT, KPA, KBT, KBA Chamber part control edges
D1, D2 Rotary positions

The invention claimed is:

1. A camshaft adjuster for a camshaft which serves to actuate cylinder valves of an internal combustion engine, wherein retardation torques in a direction of retarded cylinder valve opening times are imparted back to the camshaft adjuster by the camshaft when cams are running on, and oppositely directed advance torques in a direction of advanced cylinder valve opening times are imparted back to the camshaft adjuster by the camshaft when cams are running off, the camshaft adjuster comprising:

a pressure chamber and an adjusting member arranged in the pressure chamber, the adjusting member divides the pressure chamber into a first chamber part and a second chamber part, wherein pressure medium can be supplied to the first chamber part and the second chamber part and pressure medium can be discharged from the first chamber part and the second chamber part, such that the adjusting member is movable by a pressure difference between the first chamber part and the second chamber part, resulting in a rotation of the camshaft, wherein, when a relatively high pressure prevails in the first chamber part, the camshaft is rotated in a direction of the advanced cylinder valve opening times, and when a relatively high pressure prevails in the second chamber part, the camshaft is rotated in a direction of the retarded cylinder valve opening times, and wherein the supply and discharge of pressure medium is controllable by a control device, a torque mode or a pump mode can be selectively set by the control device, wherein in the torque mode, predominantly camshaft torques are utilized to build up pressure in the first chamber part or in the second chamber part, and in the pump mode, the pressure build-up in the first chamber part or in the second chamber part is realized predominantly by pressure medium provided by a pressure medium pump, wherein the control device comprises a control valve and a rotary transmitter arranged on the camshaft, the pressure medium can be conducted to and discharged from the first chamber part through first orifices in the camshaft, and the pressure medium can be conducted to and discharged from the second chamber part through second orifices in the camshaft, by the control valve and the rotary transmitter, and an orifice cover is arranged in the rotary transmitter such that the first orifices and the second orifices are opened up or blocked as a function of the rotary angle of the camshaft.

2. The camshaft adjuster as claimed in claim 1, wherein the orifice cover is formed by an inner side of a bearing shell in which the camshaft is mounted, the orifice cover is made discontinuous by recesses such that the first orifices and the second orifices are opened up in a region of the recesses, whereas said orifices are blocked in a region of the orifice cover.

3. The camshaft adjuster as claimed in claim 1, wherein the pump mode or the torque mode can be set by an axial displacement of a valve piston arranged in a valve housing of the control valve.

4. The camshaft adjuster as claimed in claim 3, wherein the valve housing has a pump orifice by which a supply of the pressure medium either to the first chamber part or to the second chamber part can be set such that in each case either the first chamber part or the second chamber part is pressurized, and the flow of pressure medium out of the first chamber part or the second chamber part are set by chamber part orifices in the valve housing.

5. The camshaft adjuster as claimed in claim 4, in which the valve piston has, axially spaced apart from one another, two pairs of chamber part control edges such that, by said chamber part control edges, the chamber part orifices are opened up and closed off based on an axial position of the valve piston, and furthermore, two pairs of pump control edges are formed axially between the chamber part control edges, and the inflow of pressure medium from a pressure medium pump via the pump orifice can be controlled by the pump control edges.

6. The camshaft adjuster as claimed in claim 1, wherein, for the relative axial position of the valve piston, five switching positions can be set, and in a first position, the pump mode is set for an adjustment of the camshaft in the direction of retarded cylinder valve opening times, in a second, axially subsequent switching position, the torque mode is set for an adjustment of the camshaft in the direction of retarded cylinder valve opening times, in a third, axially subsequent switching position, a camshaft adjustment is blocked, in a fourth, axially subsequent switching position, the torque mode is set for an adjustment of the camshaft in the direction of advanced cylinder valve opening times, and in a fifth, axially subsequent switching position, the pump mode is set for an adjustment of the camshaft in the direction of advanced cylinder valve opening times.

7. The camshaft adjuster as claimed in claim 3, wherein a locking mechanism is provided by which the camshaft adjuster is mechanically blocked in a locking position so as to be prevented from being adjusted, wherein the locking mechanism is hydraulically unlocked by the pressure medium, and a supply of pressure medium to the locking mechanism is connected such that the locking mechanism unlocks only when the valve piston is in an axial switching position which corresponds to an adjustment in the direction of advanced cylinder valve opening times.

8. The camshaft adjuster as claimed in claim 6, wherein the supply of the pressure medium to the locking mechanism corresponds to locking orifices in the camshaft, said locking orifices are arranged at a same level as the second orifices in the axial direction but spaced apart from the second orifices in a circumferential direction.

9. The camshaft adjuster as claimed in claim 7, wherein two of the locking orifices are arranged between in each case two of the second orifices.

* * * * *